US012359536B1

(12) United States Patent
Arrazola et al.

(10) Patent No.: US 12,359,536 B1
(45) Date of Patent: Jul. 15, 2025

(54) SUBSEA HEAT REMOVAL SYSTEM

(71) Applicant: Chevron U.S.A. Inc., San Ramon, CA (US)

(72) Inventors: Alvaro Jose Arrazola, Houston, TX (US); Harold Gordon Riordan, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 19/005,580

(22) Filed: Dec. 30, 2024

(51) Int. Cl.
*E21B 36/00* (2006.01)
*E21B 33/035* (2006.01)
*E21B 34/06* (2006.01)

(52) U.S. Cl.
CPC ..... *E21B 36/001* (2013.01); *E21B 34/066* (2013.01); *E21B 33/035* (2013.01)

(58) Field of Classification Search
CPC .... E21B 33/035; E21B 36/001; E21B 47/017; E21B 47/0175; E21B 34/066; E21B 33/064; E21B 33/076; E21B 41/0007; E21B 41/0014; E21B 41/04; E21B 41/06; E21B 41/08; E21B 41/10; E21B 43/01; E21B 43/017; E21B 43/101; F04D 29/58
See application file for complete search history.

(56) References Cited

U.S. PATENT DOCUMENTS 8,881,843 B2 * 11/2014 Todd ..... E21B 21/063 175/5
2004/0112601 A1 * 6/2004 Hache ..... E21B 47/0175 166/57
2005/0220645 A1 * 10/2005 Kerr ..... E21B 36/001 417/555.1
2010/0300751 A1 * 12/2010 Tao ..... E21B 47/017 165/154
2014/0027113 A1 * 1/2014 Veeningen ..... E21B 47/117 166/57
2015/0315874 A1 * 11/2015 Chambers ..... E21B 36/001 166/57
2018/0038061 A1 * 2/2018 Combs ..... E21B 33/03
2021/0230976 A1 * 7/2021 Critsinelis ..... E21B 43/01
2023/0250708 A1 * 8/2023 Al-Mousa ..... E21B 33/06 166/302

* cited by examiner

*Primary Examiner* — Yanick A Akaragwe
(74) *Attorney, Agent, or Firm* — Smith & Woldesenbet Law Group, PLLC

(57) ABSTRACT

A subsea heat removal system can include an inflow line having an inflow line proximal end that is connected to a pump in the water and is configured to have cooling fluid from the pump flow therethrough. The subsea heat removal system can also include a thermal transfer device having an inlet connected to an inflow line distal end, where the thermal transfer device has a thermally conductive material that is in thermal communication with an electrical device located in a wellbore. The subsea heat removal system can further include an outflow line having an outflow line distal end that is configured to be connected to an outlet of the thermal transfer device, where the outflow line is configured to have a heated version of the cooling fluid flow therethrough, and where an outflow line proximal end is located above the seabed.

20 Claims, 8 Drawing Sheets

SUBSEA HEAT REMOVAL SYSTEM

TECHNICAL FIELD

The present application is related to subsea field operations and, more particularly, to subsea heat removal systems.

BACKGROUND

During some subsea field operations, electrical and/or electronic devices and equipment are located within the wellbore. The temperatures within the wellbore can be elevated to a level that exceeds safe operating temperatures for the electrical and/or electronic devices and equipment. As a result, such electrical and/or electronic devices and equipment that operate in a wellbore that originates at the seabed may suffer from failure or a diminished useful life.

SUMMARY

In general, in one aspect, the disclosure relates to a subsea heat removal system. The subsea heat removal system can include a pump disposed in water near a seabed, where the pump is configured to pump a cooling fluid. The subsea heat removal system can also include an inflow line having an inflow line distal end and an inflow line proximal end, where the inflow line proximal end is connected to the pump in the water and is configured to have the cooling fluid flow therethrough. The subsea heat removal system can further include a thermal transfer device includes an inlet and an outlet, where the inlet of the transition is connected to the inflow line distal end, where the thermal transfer device includes a thermally conductive material, and where the thermal transfer device is in thermal communication with an electrical device located in a wellbore. The subsea heat removal system can also include an outflow line having an outflow line distal end and an outflow line proximal end, where the outflow line distal end is configured to be connected to the outlet of the thermal transfer device, where the outflow line is configured to have a heated version of the cooling fluid flow therethrough, and where the outflow line proximal end is located above the seabed.

In another aspect, the disclosure relates to a subsea field system. The subsea field system can include an electrical device located in a wellbore below a seabed. The subsea field system can also include a subsea heat removal system, which can include a pump disposed in water near the seabed, where the pump is configured to pump a cooling fluid. The subsea heat removal system of the subsea field system can also include an inflow line having an inflow line distal end and an inflow line proximal end, where the inflow line proximal end is connected to the pump in the water and is configured to have the cooling fluid flow therethrough. The subsea heat removal system of the subsea field system can further include a thermal transfer device includes an inlet and an outlet, where the inlet of the transition is connected to the inflow line distal end, where the transition includes a thermally conductive material, and where the thermal transfer device is in thermal communication with the electrical device in the wellbore. The subsea heat removal system of the subsea field system can also include an outflow line having an outflow line distal end and an outflow line proximal end, where the outflow line distal end is configured to be connected to the outlet of the thermal transfer device, where the outflow line is configured to have a heated version of the cooling fluid flow therethrough, and where the outflow line proximal end terminates above the seabed.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION

Figure 1:
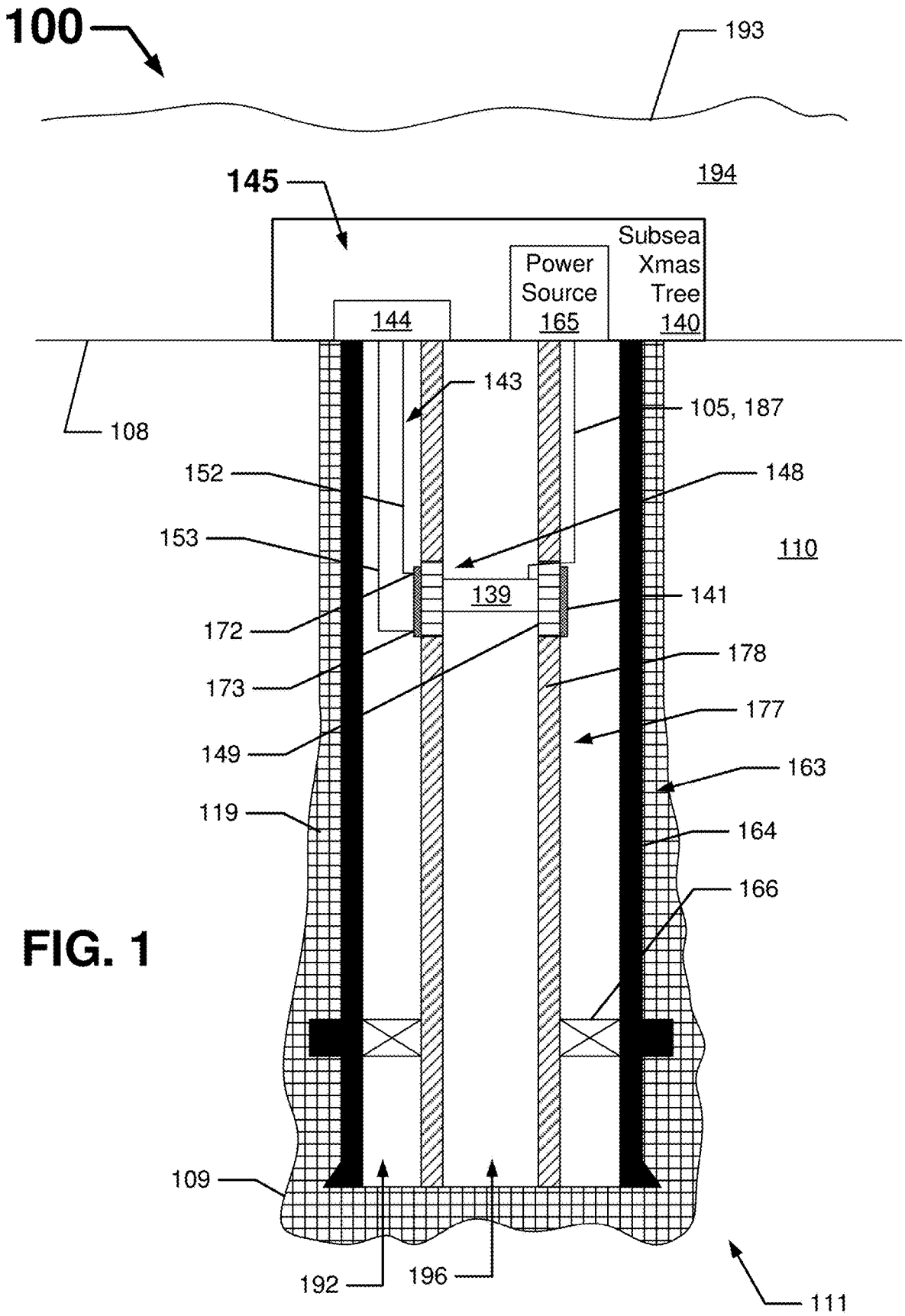
FIG. 1 shows a sectional view of a field system that includes a subsea heat removal system according to certain example embodiments.

The example embodiments discussed herein are directed to systems, methods, and devices for subsea heat removal systems. Wellbores for which example embodiments are used can be drilled and completed to extract a subterranean resource. Examples of a subterranean resource can include, but are not limited to, natural gas, oil, and water. Wellbores for which example embodiments are used can be subsea. Example embodiments can be rated for use in marine and/or hazardous environments.

Example embodiments can include multiple components that are described herein, where a component can be made from a single piece (as from a mold or an extrusion). When a component (or portion thereof) of an example embodiment for subsea heat removal is made from a single piece, the single piece can be cut out, bent, stamped, and/or otherwise shaped to create certain features, elements, or other portions of the component. Alternatively, a component (or portion thereof) of an example embodiment for subsea heat removal can be made from multiple pieces that are mechanically coupled to each other. In such a case, the multiple pieces can be mechanically coupled to each other using one or more of a number of coupling methods, including but not limited to adhesives, welding, fastening devices, compression fittings, mating threads, and slotted fittings. One or more pieces that are mechanically coupled to each other can be coupled to each other in one or more of a number of ways, including but not limited to fixedly, hingedly, rotatably, removably, slidably, and threadably.

Components and/or features described herein can include elements that are described as coupling, fastening, securing, or other similar terms. Such terms are merely meant to distinguish various elements and/or features within a component or device and are not meant to limit the capability or function of that particular element and/or feature. For example, a feature described as a "coupling feature" can couple, secure, abut against, fasten, and/or perform other functions aside from merely coupling. In addition, each component and/or feature described herein (including each component of an example subsea heat removal system) can be made of one or more of a number of suitable materials, including but not limited to metal (e.g., stainless steel), ceramic, rubber, glass, and plastic.

A coupling feature (including a complementary coupling feature) as described herein can allow one or more components (e.g., a housing) and/or portions of an example embodiment for subsea heat removal to become mechanically coupled, directly or indirectly, to another portion of the example embodiment for subsea heat removal and/or a component of a larger system. A coupling feature can include, but is not limited to, a portion of mating threads, a hinge, an aperture, a recessed area, a protrusion, a slot, and a detent. One portion of an example subsea heat removal system can be coupled to another portion of the example embodiment of a subsea heat removal system and/or a component of a larger system by the direct use of one or more coupling features.

In addition, or in the alternative, a portion of an example embodiment for subsea heat removal can be coupled to another portion of the example embodiment for subsea heat removal and/or a component of a larger system using one or more independent devices that interact with one or more coupling features disposed on a component of the example embodiment for subsea heat removal. Examples of such devices can include, but are not limited to, a fastening device (e.g., a bolt, a screw, a rivet), a pin, a hinge, an adapter, and a spring. One coupling feature described herein can be the same as, or different than, one or more other coupling features described herein. A complementary coupling feature as described herein can be a coupling feature that mechanically couples, directly or indirectly, with another coupling feature.

When used in certain systems (e.g., for certain subterranean field operations), example embodiments can be designed to help such systems comply with certain standards and/or requirements. Examples of entities that set such standards and/or requirements can include, but are not limited to, the Society of Petroleum Engineers, the American Petroleum Institute (API), the International Standards Organization (ISO), and the Occupational Safety and Health Administration (OSHA). Also, as discussed above, example embodiments for subsea heat removal can be used in marine and/or hazardous environments, and so example embodiments for subsea heat removal can be designed to comply with industry standards that apply to marine and/or hazardous environments.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components.

For example, in some embodiments, the item described by this phrase could include only a component of type A. In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C.

In some embodiments, the item described by this phrase could include a component of type A, a component of type B, and a component of type C. In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C).

In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three-digit number or a four-digit number, and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments for subsea heat removal systems will be described more fully hereinafter with reference to the accompanying drawings, in which example embodiments for subsea heat removal systems are shown. Example embodiments for subsea heat removal systems may, however, be embodied in many different forms and should not be construed as limited to the example embodiments set forth herein. Rather, these example embodiments are provided so that this disclosure will be thorough and complete, and will fully convey the scope of subsea heat removal systems to those of ordinary skill in the art. Like, but not necessarily the same, elements (also sometimes called components) in the various figures are denoted by like reference numerals for consistency.

Terms such as "first", "second", "primary," "secondary," "above", "below", "inner", "outer", "distal", "proximal", "end", "top", "bottom", "upper", "lower", "side", "left", "right", "front", "rear", and "within", when present, are used merely to distinguish one component (or part of a component or state of a component) from another. This list of terms is not exclusive. Such terms are not meant to denote a preference or a particular orientation, and they are not meant to limit embodiments of subsea heat removal systems. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a sectional view of a field system 100 that includes a subsea heat removal system 145 according to certain example embodiments. The field system 100 of FIG. 1 shows a wellbore 111 drilled into a subterranean formation 110. The wellbore 111 is defined by a wall 109. The wellbore 111 is drilled using a rig (e.g., a derrick, a tool pusher, a clamp, a tong) and field equipment (e.g., drill pipe, casing pipe, a drill bit, a fluid pumping system).

Some of this field equipment is located above (e.g., at, near) the seabed 108, and other parts of the field equipment is located within the wellbore 111 as the wellbore 111 is developed. For example, the field system 100 of FIG. 1 shows a casing string 163 is positioned within the wellbore 111 and set against the wall 109 of the wellbore 111 with cement 119. Specifically, once the wellbore 111 (or a section thereof) is drilled, the casing string 163 is inserted into the wellbore 111 and subsequently cemented to the wall 109 of the wellbore 111 to stabilize the wellbore 111 and allow for the extraction of subterranean resources (e.g., oil, natural gas) from the subterranean formation 110.

The point where the wellbore 111 begins at the seabed 108 can be called the entry point. While not shown in FIG. 1, there can be multiple wellbores 111, each with their own entry point but that are located close to the other entry points, drilled into the subterranean formation 110. In such a case, the multiple wellbores 111 can be drilled at the same pad location using the same rig and, in some cases, at least some of the same field equipment. The seabed 108 may be some distance (e.g., hundreds of feet, thousands of feet, miles) below the water line 193.

The subterranean formation 110 can include one or more of a number of formation types, including but not limited to shale, limestone, sandstone, clay, sand, and salt. In certain embodiments, a subterranean formation 110 can include one or more reservoirs in which one or more subterranean resources (e.g., oil, gas, water, steam) can be located. One or more of a number of field operations (e.g., fracturing, coring, tripping, drilling, cementing casing, extracting downhole resources) can be performed to reach an objective of a user with respect to the subterranean formation 110.

The wellbore 111 can have one or more of a number of segments, where each segment can have one or more of a number of dimensions. Examples of such dimensions can include, but are not limited to, size (e.g., diameter) of the wellbore 111, a curvature of the wellbore 111, a true vertical depth of the wellbore 111, a measured depth of the wellbore 111, and a horizontal displacement of the wellbore 111. As in this case, the wellbore 111 can also undergo multiple cementing operations, where each cementing operation covers part or all of a segment of the wellbore 111 or multiple segments of the wellbore 111. A segment of the wellbore 111 may be substantially vertical, substantially horizontal, and/or somewhere in between. A segment of the wellbore 111 may be substantially linear and/or have a curvature.

Each end of a casing pipe 164 has mating threads (a type of coupling feature) disposed thereon, allowing a casing pipe 164 to be mechanically coupled to another casing pipe 164 in an end-to-end configuration. The casing pipes 164 of the casing string 163 can be mechanically coupled to each other directly or indirectly using a coupling device, such as a coupling sleeve. Each casing pipe 164 of the casing string 163 can have a length and a width (e.g., inner diameter, outer diameter). The length of a casing pipe 164 can vary. For example, a common length of a casing pipe 164 is approximately 40 feet. The length of a casing pipe 164 can be longer (e.g., 60 feet) or shorter (e.g., 10 feet) than 40 feet. The width of a casing pipe 164 can also vary and can depend on the cross-sectional shape of the casing pipe 164. For example, when the cross-sectional shape of a casing pipe 164 is circular, which is commonly the case, the width can refer to an outer diameter, an inner diameter, or some other form of measurement of the casing pipe 164. Examples of a width in terms of an outer diameter of a casing pipe 164 can include, but are not limited to, 4½ inches, 7 inches, 7⅝ inches, 8⅝ inches, 10¾ inches, 13⅜ inches, and 14 inches. Typically, as in this case, the larger widths of the casing pipe 164 (as for casing string 163) are closer to the entry point at the seabed 108, and the width gradually decreases by segment moving toward the distal end of the wellbore 111.

The size (e.g., width, length) of a casing string 163 can be based on the information gathered using field equipment with respect to the subterranean wellbore 111. As discussed above, the walls of the casing pipes 164 of the casing string 163 have an inner surface that form a cavity that traverses the length of the casing string 163. Each casing pipe 164 of the casing string 163 can be made of one or more of a number of suitable materials, including but not limited to stainless steel.

In addition, a tubing string 177 is positioned within the wellbore 111 inside of the casing string 163. The space between the tubing string 177 and the casing string 163 in the wellbore 111 is the annulus 192. The tubing string 177 includes at least one sub 148 and a number of tubing pipes 178 that are coupled to each other end-to-end to form the tubing string 177. Each end of a tubing pipe 165 and each end of a sub 148 has mating threads (a type of coupling feature) disposed thereon, allowing a tubing pipe 178 and/or a sub 148 to be mechanically coupled to another tubing pipe 178 and/or another sub 148 in an end-to-end configuration. The one or more subs 148 and the tubing pipes 178 of the tubing string 177 can be mechanically coupled to each other directly or indirectly using a coupling device, such as a coupling sleeve. The tubing string 177 has a cavity 196 along its length.

Each tubing pipe 178 of the tubing string 177 can have a length and a width (e.g., outer diameter). The length of a tubing pipe 178 can vary. For example, a common length of a tubing pipe 178 is approximately 30 feet. The length of a tubing pipe 178 can be longer (e.g., 60 feet) or shorter (e.g., 10 feet) than 30 feet. The width of a tubing pipe 178 can also vary and can depend on the cross-sectional shape of the tubing pipe 178. For example, when the cross-sectional shape of a tubing pipe 178 is circular, which is commonly the case, the width can refer to an outer diameter, an inner diameter, or some other form of measurement of the tubing pipe 178. Examples of a width in terms of an outer diameter of a tubing pipe 178 can include, but are not limited to, 4 ½ inches, 7 inches, 7⅝ inches, 8⅝ inches, and 10¾ inches. The outer diameter of the tubing string 177 is less than the inner diameter of the casing string 163 along the depth of the wellbore 111.

The sub 148 includes a body 149 and an electrical device 139. The body 149 can have a wall that forms a cavity, inside of which is disposed the electrical device 139. The cavity of the body 149 of the sub 148 coincides with the cavity 196 of the rest of the tubing string 177. The electrical device 139 operates by receiving power and/or control signals from a power source 165 at or near the seabed 108 (e.g., integrated with the Xmas tree 140) via power transfer links 187 and/or communication links 105, respectively. Each communication link 105 may include wired (e.g., Class 1 electrical cables, electrical connectors, Power Line Carrier, RS485) and/or wireless (e.g., sound or pressure waves in a fluid in the annulus 192, Wi-Fi, Zigbee, visible light communication, cellular networking, Bluetooth, Bluetooth Low Energy (BLE), ultrawide band (UWB), WirelessHART, ISA100) technology.

Each power transfer link 187 may include one or more electrical conductors, which may be individual or part of one or more electrical cables. In some cases, as with inductive power, power may be transferred wirelessly using power transfer links 187. A power transfer link 187 may transmit power from one component (e.g., the power source 165) of the field system 100 to another (e.g., the electrical device 139 of the sub 148). Each power transfer link 187 may be sized (e.g., 12 gauge, 18 gauge, 4 gauge) in a manner suitable for the amount (e.g., 480V, 24V, 120V) and type (e.g., alternating current, direct current) of power transferred therethrough.

The electrical device 139 is configured to perform a function in the wellbore 111. Examples of an electrical device 139 may include, but are not limited to, a valve (e.g., a safety valve, an inflow control valve, a lubricator valve, an isolation valve, an isolation barrier valve), a sensor device (e.g., similar to a sensor device 260 discussed below with respect to FIG. 2), and a motor (e.g., a motor for an electrical submersible pump (ESP)). As the electrical device 139 operates, the electrical device 139 heats up. The heating of the electrical device 139 may be caused by factors that include, but are not limited to, inefficient design of the electrical device 139, the temperature of the wellbore 111 where the electrical device 139 is located, and the temperature of fluids flowing through and/or around the electrical device 139 (including the body 149 and other parts of the sub 148).

In some cases, the field system 100 may include one or more packers 166 within the annulus 192 of the wellbore 111. In such case, each packer 166 creates a total or partial seal between the inner surface of the casing string 163 and the outer surface of the tubing string 177. In this way, a packer 166 may isolate an environment (e.g., a pressure, a fluid) on each side of the packer 166 and prevent fluidic communication therethrough. In this case, a packer 166 is positioned below the sub 148 so that fluid in the annulus 192 below the packer 166 remains isolated from the sub 148, the communication links 105, the power transfer links 187, the inflow line 152 (discussed below), and the outflow line 153 (discussed below) in the annulus 192 between the packer 166 and the seabed 108.

The field system 100 also includes a subsea Xmas tree 140 that is mounted at the entry point (e.g., atop a wellhead) of the wellbore 111. The subsea Xmas tree 140 is a stack of vertical and/or horizontal valves, spools, pressure gauges, chokes, and/or other components installed as an assembly on the subsea wellhead. The subsea Xmas tree 140 is configured to provide a controllable interface between the wellbore 111 and production facilities (e.g., via a subsea pipeline). The various valves of the subsea Xmas tree 140 can be used for such purposes as testing, servicing, regulating, and/or choking the stream of produced subterranean resources coming up from the wellbore 111. In some cases, the subsea Xmas tree 140 may include one or more of a number of other components, including but not limited to a power source 165 and a sensor device.

The power source 165 that is integrated with the subsea Xmas tree 140 is configured to provide power to one or more components of the field system 100 at and/or near the Xmas tree 140. For example, the power source 165 may provide power and/or control signals to the electrical device 139 of the sub 148 via power transfer links 187 and/or communication links 105 in the form of one or more electrical cables that are positioned in the annulus 192.

In some cases, the power source 165 obtains power from a power supply (e.g., AC mains) and manipulates (e.g., transforms, rectifies, inverts) that power to provide the manipulated power to one or more other components (e.g., the electrical device 139, a sensor device, a valve of the Xmas tree 140) of the field system 100, where the manipulated power is of a type (e.g., alternating current, direct current) and level (e.g., 12V, 24V, 120V) that may be used by the other components of the field system 100.

The power source 165 may include one or more of a number of single or multiple discrete components (e.g., transistor, diode, resistor, transformer) and/or a microprocessor. The power source 165 may include a printed circuit board, upon which the microprocessor and/or one or more discrete components are positioned. In addition, or in the alternative, the power source 165 may be a source of power in itself to provide signals to the other components of the field system 100. For example, the power source 165 may be or include an energy storage device (e.g., a battery). As another example, the power source 165 may be or include a turbine-generator set where the turbine rotates using tidal flows near the seabed 108.

In addition, the field system 100 includes an example subsea heat removal system 145. The subsea heat removal system 145 may include one or more of any of a number of components. One or more of these components of the subsea heat removal system 145 are located in the water 194 near the seabed 108 (collectively referred to as seabed components 144), and one or more of these components of the subsea heat removal system 145 are located in the wellbore 111 (collectively referred to as wellbore components 143). One or more of the seabed components 144 may be integrated with the Xmas tree 140. Examples of the seabed components 144 of the subsea heat removal system 145 and their functions are discussed below with respect to FIG. 2.

The wellbore components 143 of the subsea heat removal system 145 in this case include an inflow line 152, a thermal transfer device 141, and an outflow line 153. The inflow line 152 is a medium (e.g., a tube, a flow line) through which a cooling fluid flows. Specifically, the inflow line 152 is configured to allow the cooling fluid to flow from a component (e.g., a pump) of the seabed components 144 of the subsea heat removal system 145 to the thermal transfer device 141. The inflow line 152 may be rigid and/or flexible. The inflow line 152 may be made of a thermally insulating material and/or a thermally conductive material. Part of the inflow line 152 (e.g., a proximal end or an inflow line proximal end) is positioned above the seabed 108 (e.g., in the water 194), and a remainder (e.g., a majority) of the inflow line 152 (e.g., a distal end or an inflow line distal end) is positioned in the annulus 192 in the wellbore 111.

The thermal transfer device 141 is a device that is configured to transfer heat generated by the electrical device 139 of the sub 148 to the cooling fluid that flows therethrough. The thermal transfer device 141 is made of or includes a thermally conductive material and is in thermal communication with the electrical device 139 of the sub 148 located in the wellbore 111. This allows heat from the electrical device 139 to be transferred to the thermal transfer device 141. The thermal transfer device 141 may have one or more of any of a number of configurations. For example, the thermal transfer device 141 may be in the form of a shell and tube heat exchanger. As another example, the thermal transfer device 141 may be in the form of a double pipe heat exchanger. As yet another example, the thermal transfer device 141 may be in the form of a plate heat exchanger. In some cases, the thermal transfer device 141 may be or include a condenser.

In any case, the thermal transfer device 141 includes an inlet 172 and an outlet 173. The inlet 172 is configured to connect to an end (e.g., a distal end) of the inflow line 152 (sometimes referred to as an inflow line distal end herein). When the inflow line 152 is connected to the inlet 172 of the thermal transfer device 141, the inlet 172 is configured to receive the cooling fluid pumped down by the seabed components 144 of the subsea heat removal system 145. The cooling fluid then flows through the thermal transfer device 141 and absorbs some of the heat that has been transferred to the thermal transfer device 141 by the electrical device 139.

The cooling fluid that enters the inlet 172 of the thermal transfer device 141 exits the outlet 173 of the thermal transfer device 141 as a heated version of the cooling fluid. The outlet 173 is configured to connect to an end (e.g., a distal end) of the outflow line 153 (sometimes referred to as an outflow line distal end herein). When the outflow line 153 is connected to the outlet 173 of the thermal transfer device 141, the outlet 173 is configured to deliver the heated version of the cooling fluid from the thermal transfer device 141 to the outflow line 153 so that the heated version of the cooling fluid returns above the seabed 108.

The outflow line 153 is a medium (e.g., a tube, a flow line) through which a heated version of the cooling fluid flows. Specifically, the outflow line 153 is configured to allow the heated version of the cooling fluid to flow from the thermal transfer device 141 to a component (e.g., a pump, the water 194) of the seabed components 144 of the subsea heat removal system 145. The outflow line 153 may be rigid and/or flexible. The outflow line 153 may be made of a thermally insulating material and/or a thermally conductive material. Part of the outflow line 153 (e.g., a proximal end or an outflow line proximal end) is positioned above the seabed 108 (e.g., in the water 194), and a remainder (e.g., a majority) of the outflow line 153 (e.g., a distal end or an outflow line distal end) is positioned in the annulus 192 in the wellbore 111.

In this case, the terms "inflow" and "outflow" are made with respect to the thermal transfer device 141 and the electrical device 139. Alternatively, when the perspective of the seabed components 144 of the subsea heat removal system 145 is used, the terms "inflow" and "outflow" may be reversed. Either way, the functions of what is described herein as the outflow line 153 and the inflow line 152 do not change if the names of those lines happen to be reversed. Similarly, the terms "inlet" (e.g., inlet 172) and "outlet" (outlet 173) are made with respect to the thermal transfer device 141 in the wellbore 111. Alternatively, when the perspective of a seabed component 144 is used, the terms "inlet" and "outlet" may be reversed. Either way, the functions of what is described herein as the inlet 172 and the outlet 173 do not change if the names of those lines happen to be reversed.

Figure 2:
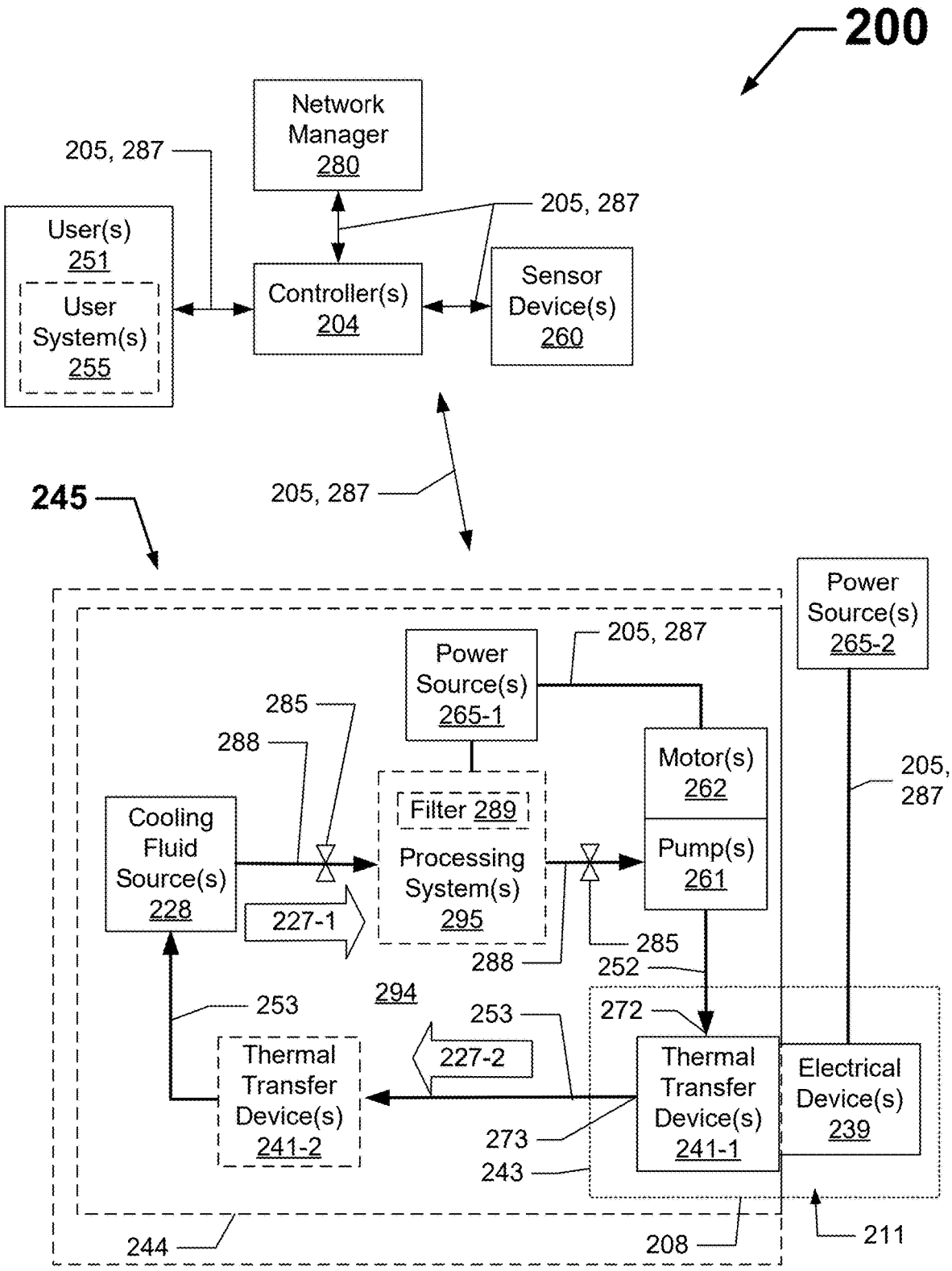
FIG. 2 shows a block diagram of a field system that includes a subsea heat removal system according to certain example embodiments.

FIG. 2 shows a block diagram of a field system 200 that includes a subsea heat removal system 245 according to certain example embodiments. Referring to the description above with respect to FIG. 1, the field system 200 of FIG. 2 includes one or more cooling fluid sources 228, one or more wellbores 211, an example subsea heat removal system 245, one or more controllers 204, one or more sensor devices 260, one or more users 251 (including one or more optional user systems 255), a network manager 280, one or more power sources 265, and one or more electrical devices 239 located in one or more wellbores 211.

The example subsea heat removal system 245 includes multiple wellbore components 243 and multiple seabed components 244. In this case, the wellbore components 243 of the subsea heat removal system 245 are positioned in the one or more wellbores 211 and include one or more thermal transfer devices 241 (e.g., thermal transfer device 241-1), part of one or more inflow lines 252, and part of one or more outflow lines 253. Also in this case, the seabed components 244 of the subsea heat removal system 245 are positioned in the water 294 at or above the seabed 208 and include one or more motors 262, one or more pumps 261, one or more thermal transfer devices 241, part of the one or more inflow lines 252, part of the one or more outflow lines 253, one or more optional thermal transfer devices 239, an optional processing system 295, piping 288, and one or more valves 285.

The components shown in FIG. 2 are not exhaustive, and in some embodiments, one or more of the components shown in FIG. 2 may not be included in the example field system 200. Any component of the field system 200 may be discrete or combined with one or more other components of the field system 200. Also, one or more components of the field system 200 may have different configurations. For example, a controller 204 may be included with the seabed components 244 of the subsea heat removal system 245. As another example, one or more of the sensor devices 260 may be disposed within or disposed on other components (e.g., the piping 288, a valve 285, the processing system 295, the power source 265-1, a wellbore 211) of the subsea heat removal system 245. As another example, a controller 204, rather than being a stand-alone device, may be part of one or more other components (e.g., part of the motor 262, part of the processing system 295) of the subsea heat removal system 245.

The field system 200 of FIG. 2 may include one or more wellbores 211. Each of the wellbores 211 of the field system 200 may be substantially similar to the wellbores 111 discussed above. Some or all of the wellbores 211 may be from a common pad. Over time, a wellbore 211 may be used for different purposes. For example, a wellbore 211 may be used as a production well at one time, and at another time, the wellbore 211 may be used as an injection well.

A cooling fluid 227 of FIG. 2 is configured to help remove some of the heat generated by one or more of the electrical devices 239. A cooling fluid 227 may be at least partially in liquid and/or gaseous form. A cooling fluid 227 may be naturally occurring (e.g., water 294) or manufactured (e.g., engine coolant, a synthetic material). An example subsea heat removal system 245 may include a single cooling fluid 227 or multiple cooling fluids 227. The field system 200 may include one or more cooling fluid sources 228. Each cooling fluid source 228 may hold one or more cooling fluids 227. A cooling fluid source 228 may be or include, but is not limited to, a natural vessel (e.g., the seabed 208) and a man-made storage tank or other type of vessel.

In some cases, a cooling fluid source 228 may be or include a reserve tank or vessel that is used to store a volume of cooling fluid 227 that may be used to replenish or replace some or all of the cooling fluid 227 flowing through the one or more inflow lines 252 and the one or more outflow lines 253. A cooling fluid source 228 may be positioned in the water 294, regardless of whether it is enclosed in a specialized housing or not. A cooling fluid source 228 may be mounted to and/or integrated with the subsea Xmas tree (e.g., subsea Xmas tree 140).

The cooling fluid 227 is circulated within at least some of the seabed components 244 of the subsea heat removal system 245 using piping 288. For example, in this case, the piping 288 facilitates the flow of the cooling fluid 227 from a cooling fluid source 228 to a processing system 295, and from the processing system 295 to a pump 261. The piping 288 may include multiple pipes, ducts, elbows, joints, sleeves, collars, and similar components that are coupled to each other (e.g., using coupling features such as mating threads) to establish a network for transporting the cooling fluid 227 among the seabed components 244 of the subsea heat removal system 245. Each component of the piping 288 may have an appropriate size (e.g., inner diameter, outer diameter) and be made of an appropriate material (e.g., steel, PVC) to safely and efficiently handle the pressure, temperature, flow rate, and other characteristics of the cooling fluid 227 that flows therethrough.

There may be a number of valves 285 placed directly or indirectly in-line with the piping 288, the inflow lines 252, and/or the outflow lines 253 (or portions thereof) at various locations in the subsea heat removal system 245 to control the flow of the cooling fluid 227. A valve 285 may have one or more of any of a number of configurations, including but not limited to a guillotine valve, a ball valve, a gate valve, a butterfly valve, a pinch valve, a needle valve, a plug valve, a diaphragm valve, and a globe valve. One valve 285 may be configured the same as or differently compared to another valve 285 in the subsea heat removal system 245. Also, one valve 285 may be controlled (e.g., manually by a user 251, automatically by a controller 204) the same as or differently compared to another valve 285 in the subsea heat removal system 245. A valve 285 may be positioned in the water 294, regardless of whether it is enclosed in a specialized housing or not. A valve 285 may be mounted to and/or integrated with the subsea Xmas tree (e.g., subsea Xmas tree 140).

Each power source 265-1 of the subsea heat removal system 245 may be substantially similar to the power source 165 discussed above. For example, the power source 265-1 may provide power and/or control signals to one or more of the motors 262 and/or some or all of the processing system 295 of the subsea heat removal system 245 via power transfer links 287 and/or communication links 205 in the form of one or more electrical cables. When a motor 262 operates using the power provided by a power source 265-1, the motor 262 causes one or more pumps 261 to operate, which causes the cooling fluid 227 to flow through the piping 288, the inflow lines 252, and the outflow lines 253.

Each power source 265-1, motor 262, and pump 261 are configured to operate in the subsea environment that exists at or near the seabed 208. In some cases, the operation of a motor 262 is controlled by a controller 204. A motor 262 may be fixed speed or variable speed. A pump 261 may be any type of pump, including but not limited to a centrifugal pump, a diaphragm pump, a submersible pump, a piston pump, a lobe pump, a screw pump, and a displacement pump. The power sources 265, the pumps 261, and the motors 262 are positioned in the water 294, regardless of whether they are enclosed in specialized housings or not. The power sources 265, the pumps 261, and the motors 262 may be mounted to and/or integrated with the subsea Xmas tree (e.g., subsea Xmas tree 140).

In some cases, a power source 265 (e.g., power source 265-1, power source 265-2) obtains power from a power supply (e.g., AC mains) and manipulates (e.g., transforms, rectifies, inverts) that power to provide the manipulated power to one or more other components (e.g., a motor 262, a sensor device 260, a valve 285, a controller 204) of the subsea heat removal system 245, where the manipulated power is of a type (e.g., alternating current, direct current) and level (e.g., 12V, 24V, 120V) that may be used by the other components of the subsea heat removal system 245.

A power source 265 may include one or more of a number of single or multiple discrete components (e.g., transistor, diode, resistor, transformer) and/or a microprocessor. A power source 265 may include a printed circuit board, upon which the microprocessor and/or one or more discrete components are positioned. In addition, or in the alternative, a power source 265 may be a source of power in itself to provide power and/or control signals to the other components of the subsea heat removal system 245. For example, a power source 265 may be or include an energy storage device (e.g., a battery). As another example, a power source 265 may be or include a turbine-generator set where the turbine rotates using tidal flows near the seabed 208.

In some cases, the power source 265 has a modular configuration so that part (e.g., a battery array) of the power source 265 may be removed and replaced while another part (e.g., another battery array) of the power source 265 provides power to one or more of the motors 262 and/or some or all of the processing system 295. When the field system 200 has multiple power sources 265, the configuration of one power source 265 may be the same as, or different than, the configuration of one or more of the other power sources 265. A power source 265 may provide power to more than one component of the field system 200. For example, the power source 265-1 in this case provides power to a motor 262 and the processing system 295.

The optional processing system 295 may be configured to process (e.g., filter, change chemical composition, mix, agitate, separate) the cooling fluid 227. For example, the processing system 295 may include a filter 289 that is configured to remove sand and other debris from cooling fluid 227 in the form of water 294 that is taken in by the piping 288 and/or the inflow line 252 on a continuous basis. The processing system 295 may operate on a continuous basis or in discrete periods or intervals of time. In some cases, the operation of the processing system 295 is controlled by a controller 204. The components of the processing system 295 may be contained within a central housing. Alternatively, one or more of the components of the processing system 295 may be discretely positioned.

Each component of the processing system 295 may be configured to operate in the subsea environment that exists at or near the seabed 208. Each component of the processing system 295 may be positioned in the water 294, regardless of whether it is enclosed in a specialized housing or not. Each component of the processing system 295 may be mounted to and/or integrated with the subsea Xmas tree (e.g., subsea Xmas tree 140).

The processing system 295 may include one or more of a number of various pieces of equipment in order to perform its processing functions. Such equipment may include, but is not limited to, a pump (e.g., similar to a pump 261), a motor (e.g., similar to a motor 262), a filter 289, a centrifuge, a heater, a blower, a condenser, a vessel, a funnel, a strainer, a separator, an agitator, a paddle, a circulating system, an aerator, a heat exchanger (e.g., similar to a thermal transfer device 241), a column, a separator, a mixer (e.g., a centrifuge mixer, a desander, a tumbler mixer, a homogenizer, a static mixer, a drum mixer, a fluidization mixer, agitator mixers, paddle mixers, an emulsifier, a drum mixer, a pail mixer, a convective mixer, an agitator, a batch mixer, and a ribbon mixer), a controller (e.g., similar to a controller 204), and a sensor device (e.g., similar to a sensor device 260). These components or pieces of equipment may operate in series and/or in parallel with each other. The processing system 295 may be controlled by a user 251 (e.g., a human being), by a controller 204 external to the subsea heat removal system 245, by its own controller (e.g., similar to a controller 204), and/or by a controller 204 of the subsea heat removal system 245.

In some cases, some or all of the processing system 295 may be operated based on measurements of one or more parameters associated with the cooling fluid 227 and made by one or more sensor devices 260. Each sensor device 260 of the field system 200 includes one or more sensors that measure one or more parameters (e.g., pressure, flow rate, temperature, humidity, depth, location, content of cooling fluid 227, voltage, electrical current, tidal current, etc.). Examples of a sensor of a sensor device 260 may include, but are not limited to, a temperature sensor, a flow sensor, a pressure sensor, a gas spectrometer, a voltmeter, an ammeter, a gyroscope, a spectrograph, a gas chromatograph, and a camera. A sensor device 260 may be a stand-alone device or integrated with another component of the field system 200, including another component (e.g., a valve 285) of the subsea heat removal system 245.

As discussed above, a parameter measured by a sensor device 260 may be associated with the cooling fluid 227. In some cases, in addition, a parameter measured by a sensor device 260 may be associated with one or more other components (e.g., a motor 262, a power source 265, a component of the processing system 295) of the subsea heat removal system 245. For example, a sensor device 260 may be configured to determine the degree to which a valve 285 within the piping 288 of the subsea heat removal system 245 is open or closed. In some cases, a sensor device 260 may additionally or alternatively measure a parameter outside of the subsea heat removal system 245. For example, a sensor device 260 may be configured to measure a parameter associated with a manifold, a pipeline, and/or some other part of a field system 200 not shown in FIG. 2 at a particular time.

In some cases, a number of sensor devices 260, each measuring a different parameter, may be used in combination to determine and confirm whether a controller 204 should take a particular action (e.g., operate a valve 285, adjust the speed of a motor 262, operate or adjust the operation of a component of the processing system 295). When a sensor device 260 includes its own controller (or portions thereof), similar to a controller 204, then the sensor device 260 may be considered a type of computer device, as discussed below with respect to FIG. 4.

To control the cooling fluid 227 at a given point in time, the amount of the cooling fluid 227 (including components thereof) may be regulated in real time. This regulation may be performed automatically by a controller (e.g., a controller 204 of the subsea heat removal system 245) and/or manually by a user 251 (which may include an associated user system 255). This regulation may be performed using equipment such as the processing system 295 (including portions thereof), pumps 261, compressors, the piping 288, valves 285, regulators, sensor devices 260, etc. The cooling fluid 227 may have any of a number of different compositions that are naturally occurring, created (e.g., mixed), and/or man-made.

The example subsea heat removal system 245 includes at least one thermal transfer device 241. Each thermal transfer device 241 of the subsea heat removal system 245 of FIG. 2 may be substantially the same as the thermal transfer device 141 of the subsea heat removal system 145 discussed above. For example, each thermal transfer device 241 in the wellbore 211 is a device that transfers heat generated by an electrical device 239 of a sub (e.g., sub 148) to the cooling fluid 227 received from the inflow line 252. A thermal transfer device 241 may have one or more of any of a number of configurations. The cooling fluid 227 that enters the inlet 272 of a thermal transfer device 241 exits the outlet 273 of the thermal transfer device 241 as a heated version of the cooling fluid 227 into an outflow line 253.

The electrical device 239 of FIG. 2 may be substantially the same as the electrical device 139 of FIG. 1. For example, the electrical device 139 may be housed within a body (e.g., body 149) of a sub (e.g., sub 148) that is integrated with tubing pipe (e.g., tubing pipe 178) as part of a tubing string (e.g., tubing string 177). The electrical device 239 operates by receiving power and/or control signals from a power source 265-2 at or near the seabed 208 (e.g., integrated with an Xmas tree 140) via power transfer links 287 and/or communication links 205, respectively.

In certain example embodiments, there is one thermal transfer device 241 for each electrical device 239 in a wellbore 211. As a result, at least one thermal transfer device 241 is among the wellbore components 243 of the subsea heat removal system 245. In some cases, as when the subsea heat removal system 245 is configured as a closed loop system (as opposed to an open loop system), one or more thermal transfer devices 241 may be among the seabed components 244 of the subsea heat removal system 245. For example, in this case, thermal transfer device 241-2 is among the seabed components 244 of the subsea heat removal system 245 and uses the relatively colder temperature of the water 294 to absorb some of the heat of the heated version of the cooling fluid 227 before the cooling fluid 227 is sent back down the wellbore 211 to flow through the thermal transfer device 241-1.

When the subsea heat removal system 245 includes multiple thermal transfer devices 241, the configuration of one thermal transfer device 241 may be the same as, or different than, the configuration of one or more of the other thermal transfer devices 241. A thermal transfer device 241 (e.g., thermal transfer device 241-2) that is among the seabed components 244 of the subsea heat removal system 245 may be positioned in the water 294, regardless of whether it is enclosed in a specialized housing or not. A thermal transfer device 241 may be mounted to and/or integrated with a subsea Xmas tree (e.g., subsea Xmas tree 140).

A user 251 may be any person that interacts, directly or indirectly, with a controller 204 and/or any other component of the field system 200, including any component of the example subsea heat removal system 245. Examples of a user 251 may include, but are not limited to, a business owner, an engineer, a company representative, a geologist, a consultant, a drilling engineer, a contractor, and a manufacturer's representative. A user 251 may use one or more user systems 255, which may include a display (e.g., a GUI). A user system 255 of a user 251 may interact with (e.g., send data to, obtain data from) a controller 204 via an application interface and using the communication links 205. The user 251 may also interact directly with a controller 204 through a user interface (e.g., keyboard, mouse, touchscreen). Examples of a user system 255 may include, but are not limited to, a cell phone, a smart phone, a desktop computer, a laptop computer, a tablet, and a handheld electronic device.

The network manager 280 is a device or component that controls all or a portion (e.g., a communication network, a controller 204) of the field system 200 or portions thereof including one or more components of the subsea heat removal system 245. The network manager 280 may be substantially similar to some or all of a controller 204, as described above. For example, the network manager 280 may include a controller that has one or more components and/or similar functionality to some or all of a controller 204. Alternatively, the network manager 280 may include one or more of a number of features in addition to, or altered from, the features of a controller 204. As described herein, control and/or communication with the network manager 280 may include communicating with one or more other components of the field system 200 (including one or more components of the subsea heat removal system 245) and/or another system. In such a case, the network manager 280 may facilitate such control and/or communication. The network manager 280 may be called by other names, including but not limited to a master controller, a network controller, and an enterprise manager. The network manager 280 may be considered a type of computer device, as discussed below with respect to FIG. 4.

Interaction between each controller 204, the sensor devices 260, the users 251 (including any associated user systems 255), the network manager 280, and other components (e.g., the valves 285, the processing system 295) of the field system 200, including other components of the subsea heat removal system 245, may be conducted using communication links 205 and/or power transfer links 287. The power transfer links 287 and the communication links 205 of FIG. 2 are substantially the same as the power transfer links 187 and the communication links 105, respectively, of FIG. 1.

A controller 204 of the field system 200 is configured to communicate with and in some cases control one or more of the other components (e.g., a sensor device 260, a motor 262, the processing system 295, a valve 285, another controller 204) of the field system 200, including other components of the subsea heat removal system 245. A controller 204 performs any of a number of functions that include, but are not limited to, obtaining and sending data, evaluating data, following protocols, running algorithms, and sending commands.

Figure 3:
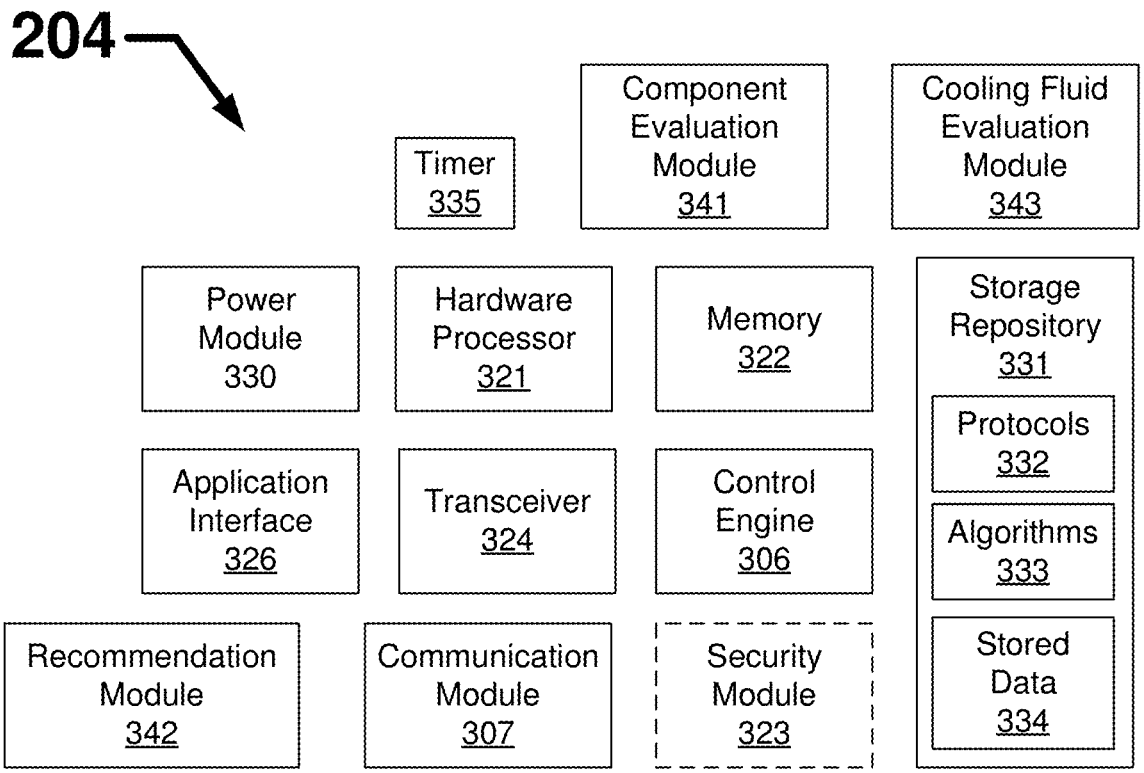
FIG. 3 shows a block diagram of a controller of the field system of FIG. 2 according to certain example embodiments.

A controller 204 may include one or more of a number of components. For example, as shown in FIG. 3, such components of a controller 204 may include, but are not limited to, a control engine, a communication module, a timer, a power module, a storage repository, a hardware processor, a memory, a transceiver, an application interface, and a security module. A controller 204 (or components thereof) may be located at or near the various components of the field system 200, including the subsea heat removal system 245. In addition, or in the alternative, a controller 204 (or components thereof) may be located remotely from (e.g., in the cloud, at an office building) the various components of the field system 200, including the other components of the subsea heat removal system 245.

When there are multiple controllers 204 (e.g., one controller 204 for one or more of the power sources 265, another controller 204 for a motor 262, yet another controller 204 for the processing system 295), each controller 204 may operate independently of each other. Alternatively, two or more of the multiple controllers 204 may work cooperatively with each other. As yet another alternative, one of the controllers 204 may control some or all of one or more other controllers 204 in the field system 200 or portion thereof (e.g., the subsea heat removal system 245). Each controller 204 may be considered a type of computer device, as discussed below with respect to FIG. 4.

As discussed above, one or more of the controllers 204 of the field system 200 may be part of the example subsea heat removal system 245. FIG. 3 shows a block diagram of a controller 204 of the subsea heat removal system 245 of the field system 200 of FIG. 2 according to certain example embodiments. Referring to the description above with respect to FIGS. 1 and 2, the controller 204 includes multiple components or modules. For example, as shown in FIG. 3, the components of such a controller 204 of the subsea heat removal system 245 may include, but are not limited to, a control engine 306, a component evaluation module 341, a cooling fluid evaluation module 343, a recommendation module 342, a communication module 307, a timer 335, a power module 330, a storage repository 331, a hardware processor 321, a memory 322, a transceiver 324, an application interface 326, and, optionally, a security module 323. In such a case, a controller 204 of the example subsea heat removal system 245 may be configured to perform analysis (e.g., chemistry analysis, temperature analysis, flow rate analysis) on the cooling fluid 227 and/or one or more other components of the subsea heat removal system 245. In this way, a controller 204 may be used, for example, to monitor the status of the example subsea heat removal system 245 in real time.

The various components of the controller 204 may be centrally located. In addition, or in the alternative, some of the components of the controller 204 may be located remotely from (e.g., in the cloud, at an office building, on a vessel floating in the water 294) one or more of the other components of the controller 204. The components shown in FIG. 3 are not exhaustive, and in some embodiments, one or more of the components shown in FIG. 3 may not be included in the example controller 204 of the subsea heat removal system 245. Any component of the controller 204 may be discrete or combined with one or more other components of the controller 204. Also, one or more components of the controller 204 may have different configurations. For example, the controller 204, rather than being a stand-alone device, may be part of one or more other components of the subsea wellhead fatigue damage evaluation system. For instance, part of the controller 204 may be integrated with a sensor device 260, the processing system 295, the power source 265-1, and/or some other component of the subsea heat removal system 245.

The storage repository 331 of the controller 204 may be a persistent storage device (or set of devices) that stores software and data used to assist the controller 204 in communicating with one or more other components of the field system 200 (including other components of the example subsea heat removal system 245), such as the users 251 (including associated user systems 255), the network manager 280, the other controllers 204, the sensor devices 260, the power sources 265, the processing system 295, the valves 285, the motors 262, and/or any other components of the field system 200, including other components of the subsea heat removal system 245. In one or more example embodiments, the storage repository 331 stores one or more protocols 332, one or more algorithms 333, and stored data 334.

The protocols 332 of the storage repository 331 may be any procedures (e.g., a series of method steps) and/or other similar operational processes that the control engine 306 of the controller 204 follows based on certain conditions at a point in time. The protocols 332 may include any of a number of communication protocols that are used to send and/or obtain data between the controller 204 and other components of the field system 200, including other components of the subsea heat removal system 245. Such protocols 332 used for communication may be a time-synchronized protocol. Examples of such time-synchronized protocols may include, but are not limited to, a highway addressable remote transducer (HART) protocol, a wirelessHART protocol, and an International Society of Automation (ISA) 100 protocol. In this way, one or more of the protocols 332 may provide a layer of security to the data transferred within the field system 200. Other protocols 332 used for communication may be associated with the use of Wi-Fi, Zigbee, visible light communication (VLC), cellular networking, BLE, UWB, and Bluetooth.

The algorithms 333 may be or include any formulas, mathematical models, forecasts, simulations, and/or other similar tools that a component (e.g., the control engine 306, the component evaluation module 341, the cooling fluid evaluation module 343) of the controller 204 uses to reach a computational conclusion. For example, one or more algorithms 333 may be used, in conjunction with one or more protocols 332, to assist the controller 204 to obtain values associated with measurements of a parameter, made by one or more of the sensor devices 260, associated with the cooling fluid 227 and/or the operation of a component of the subsea heat removal system 245.

As another example, one or more algorithms 333 may be used, in conjunction with one or more protocols 332, to assist the controller 204 (and more specifically the component evaluation module 341) to use the values associated with the measurements to generate a result (e.g., a numeric value, a range of probabilities, a current or pending failure of a component of the subsea heat removal system 245). As another example, one or more algorithms 333 may be used, in conjunction with one or more protocols 332, to assist the controller 204 (and more specifically the cooling fluid evaluation module 343) to use the values associated with the measurements to evaluate the cooling fluid 227 at a point in time or over time.

As yet another example, one or more algorithms 333 may be used, in conjunction with one or more protocols 332, to assist the controller 204 to compare the result of an algorithm 333 with a range of acceptable values (e.g., stored data 334), where the range of acceptable values is established using prior results (e.g., stored data 334) of the algorithm 333. As still another example, one or more algorithms 333 may be used, in conjunction with one or more protocols 332, to assist the controller 204 to modify or establish a new algorithm 33 and/or protocol 332 based on differences between expected values and actual values. As yet another example, one or more algorithms 333 may be used, in conjunction with one or more protocols 332, to assist the controller 204 (and more specifically the recommendation module 342) to make specific recommendations as to what portions of the subsea heat removal system 245 needs maintenance, repair, and/or replacement.

An algorithm 333 may be or be based on machine learning and/or an analytical model. For example, the control engine 306 of the controller 204, through the use of one or more protocols 332 and/or one or more algorithms 333, may implement machine learning as a way to evolve over time with new data and associated changes that may result from the new data. The control engine 306 may use, for example, supervised learning, unsupervised learning, semi-supervised learning, and/or reinforcement learning, as those terms are known in the art of machine learning. In this case, these types of machine learning are effective with sufficient data (e.g., measurements from sensor devices 260) and use of algorithms 333 and/or protocols 332 that automatically build mathematical models using sample data—also known as "training data".

In this way, for example, the controller 204 may measure and interpret the measurements of one or more parameters associated with the cooling fluid 227 and/or operation of the subsea heat removal system 245 in order to establish baselines, compare subsequent data to baselines, adjust baselines, perform retroactive analysis, assess a wellbore 211, assess an electrical device 239, recommend a different composition of the cooling fluid 227, recommend a replacement to an existing component of the subsea heat removal system 245, etc., using data and language elements native to the controller 204. Using this flexibility allowed by the learning protocols 332 and/or algorithms 333, the controller 204 may scale to disparate vendor solutions and 'build' asset development optimization scenarios and recommendations. The learning protocols 332 and/or algorithms 333 may use or include large language models (LLM) to implement unique classification/semantic matching properties that may assist in the development of asset optimization by the controller 204.

The learning protocols 332 and/or algorithms 333 that may be used and trained by the control engine 306 may include, but are not limited to, instance-based learning algorithms, artificial neural network algorithms, deep learning algorithms, and ensemble algorithms. Instance-based learning algorithms typically build up a database of example data and compare new data to the database using a similarity measure in order to find the best match and make a prediction. For this reason, instance-based methods are also called winner-take-all methods and memory-based learning. Focus may be put on the representation of the stored instances and similarity measures used between instances. Instance-based algorithms may be computationally expensive for very large datasets since they save all training instances/data points and are sensitive to data noise.

Artificial neural networks may be fairly similar to the human brain. For example, artificial neural networks may be made up of artificial neurons, take in multiple inputs, and produce specific outputs. Artificial neural networks may be an enormous subfield comprised of a large number of neural network architectures and hundreds of algorithms and variations for different types of problems. Artificial neural networks may be biologically inspired computational simulations for certain specific tasks like clustering, classification, or pattern recognition.

Deep learning algorithms may be a modern update to artificial neural networks by building much larger and more complex neural networks. With deep learning, many methods may be applied to very large datasets. Various architectures may be applied for deep learning algorithms. Deep learning may have a high computational cost because much of its development requires advanced processing, storage hardware, and ML platforms/APIs.

Ensemble algorithm methods may be models composed of multiple weaker models that are independently trained and whose predictions are combined in some way to make the overall prediction. Various combination techniques (e.g., averaging, max voting, bagging/bootstrapping (sampling subsets of original complete dataset), boosting) may be applied. Unlike other standard ensemble methods where models are trained in isolation, the boosting technique may employ an iterative approach, training models in succession, with each new model being trained to correct the errors made by the previous ones. Models may be added sequentially until no further improvements may be made.

Stored data 334 may be any data associated with the various equipment (e.g., the processing system 295, a power source 265, a sensor device 260), including associated components, of the subsea heat removal system 245, the user systems 255, the network manager 280, the other controllers 204, the sensor devices 260 outside the subsea heat removal system 245, measurements made by the sensor devices 260, specifications of the sensor devices 260, the composition of a cooling fluid 227, the temperature ranges of the cooling fluid 227, threshold values, ranges of acceptable values, tables, results of previously run or calculated algorithms 333, updates to protocols 332 and/or algorithms 333, user preferences, and/or any other suitable data. Such data may be any type of data, including but not limited to historical data, present data, and future data (e.g., forecasts). The stored data 334 may be associated with some measurement of time derived, for example, from the timer 335.

Examples of a storage repository 331 may include, but are not limited to, a database (or a number of databases), a file system, cloud-based storage, a hard drive, flash memory, some other form of solid-state data storage, or any suitable combination thereof. The storage repository 331 may be located on multiple physical machines, each storing all or a portion of the protocols 332, the algorithms 333, and/or the stored data 334 according to some example embodiments. Each storage unit or device may be physically located in the same or in a different geographic location.

The storage repository 331 may be operatively connected to the control engine 306. In one or more example embodiments, the control engine 306 includes functionality to communicate with the users 251 (including associated user systems 255), the other controllers 204, the sensor devices 260, the network manager 280, and any other components in the field system 200 (including other components of the subsea heat removal system 245). More specifically, the control engine 306 sends information to and/or obtains information from the storage repository 331 in order to communicate with the users 251 (including associated user systems 255), the other controllers 204, the sensor devices 260, the network manager 280, and any other components of the field system 200 (including other components of the subsea heat removal system 245). As discussed below, the storage repository 331 may also be operatively connected to the communication module 307 in certain example embodiments.

In certain example embodiments, the control engine 306 of the controller 204 controls the operation of one or more components (e.g., the communication module 307, the timer 335, the transceiver 324) of the controller 204. For example, the control engine 306 may activate the communication module 307 when the communication module 307 is in "sleep" mode and when the communication module 307 is needed to send data obtained from another component (e.g., a sensor device 260, another controller 204) in the field system 200, including other components of the subsea heat removal system 245. In addition, the control engine 306 of the controller 204 may control the operation of one or more other components (e.g., a sensor device 260, another controller 204), or portions thereof, of the field system 200 (including components of the subsea heat removal system 245).

The control engine 306 of the controller 204 may communicate with one or more other components of the field system 200 (including other components of the subsea heat removal system 245). For example, the control engine 306 may use one or more protocols 332 to facilitate communication with the sensor devices 260 of the field system 200 (including the example subsea heat removal system 245) to obtain data (e.g., measurements of various parameters, such as temperature, pressure, proximity, and flow rate), whether in real time or on a periodic basis, and/or to instruct a sensor device to take a measurement. The control engine 306 may use measurements (including the associated values) of parameters taken by the sensor devices 260 to perform one or more steps in evaluating the example subsea heat removal system 245 using one or more protocols 332 and/or one or more algorithms 333.

For instance, the control engine 306 may use one or more algorithms 333 and/or one or more protocols 332 to obtain values associated with measurements of one or more parameters associated with a subsea heat removal system 245, including the cooling fluid 227. If the sensor device 260 that made the measurement is not capable of generating an associated value for the measurement, then the control engine 306, using one or more algorithms 333, one or more protocols 332 and/or stored data 334, may generate values based on the measurements. In some cases, the control engine 306, using one or more algorithms 333, one or more protocols 332 and/or stored data 334, may validate and/or format the measurements made by a sensor device 260 and received by the control engine 306 before the measurements are used by the controller 204 and/or communicated to another component (e.g., a user system 255, the network manager 280) in the field system 200, including other components of components of the subsea heat removal system 245.

As still another example, the control engine 306 may use one or more algorithms 333 and/or one or more protocols 332 to use the values associated with the measurements to generate a result (e.g., a numeric value, a range of probabilities). As yet another example, the control engine 306 may use one or more algorithms 333 and/or one or more protocols 332 to compare the result of an algorithm 333 with a range of acceptable values (e.g., stored data 334), where the range of acceptable values is established using prior results (e.g., stored data 334) of the algorithm 333. As still another example, the control engine 306, in support of the component evaluation module 341, may use one or more algorithms 333 and/or protocols 332 to determine that a component of the subsea heat removal system 245 has a potential failure when the result of an algorithm 333 falls outside the range of acceptable values.

As yet another example, the control engine 3306 of the controller 204, in support of the cooling fluid evaluation module 343, may use one or more algorithms 333, in conjunction with one or more protocols 332, to determine whether the volume and/or the chemical composition of the cooling fluid 227 is within a range of acceptable values. As yet another example, the control engine 306, in support of the recommendation module 342, may use one or more algorithms 333 and/or one or more protocols 332 to make specific recommendations as to what portions of the subsea heat removal system 245 should receive maintenance and/or repair.

The control engine 306 may generate and process data associated with control, communication, and/or other signals sent to and obtained from the users 251 (including associated user systems 255), the other controllers 204, the sensor devices 260, the network manager 280, and any other components of the field system 200, including other components of the subsea heat removal system 245. In certain embodiments, the control engine 306 of the controller 204 may communicate with one or more components of a system external to the field system 200. For example, the control engine 306 may interact with an inventory management system by ordering, in real time, replacements for components or pieces of equipment (e.g., a sensor device 260, a valve 285, a motor 262) within the system that has failed or is failing. As another example, the control engine 306 may interact with a contractor or workforce scheduling system, in real time, by arranging for the labor needed to replace a component or piece of equipment in the system. In this way and in other ways, the controller 204 is capable of performing a number of functions beyond what could reasonably be considered a routine task.

In certain example embodiments, the control engine 306 may include an interface that enables the control engine 306 to communicate with the other controllers 204, the sensor devices 260, the user systems 255, the network manager 280, and any other components of the field system 200, including other components of components of the subsea heat removal system 245. For example, if a user system 255 operates under IEC Standard 62386, then the user system 255 may have a serial communication interface that will transfer data to the controller 204. Such an interface may operate in conjunction with, or independently of, the protocols 332 used to communicate between the controller 204 and the users 251 (including corresponding user systems 255), the other controllers 204, the sensor devices 260, the network manager 280, and any other components of the field system 200, including other components of the subsea heat removal system 245.

The control engine 306 (or other components of the controller 204) may also include one or more hardware components and/or software elements to perform its functions. Such components may include, but are not limited to, a universal asynchronous receiver/transmitter (UART), a serial peripheral interface (SPI), a direct-attached capacity (DAC) storage device, an analog-to-digital converter, an inter-integrated circuit (I2C), and a pulse width modulator (PWM).

The component evaluation module 341 of the controller 204 of the example subsea heat removal system 245 may be configured to evaluate, in real time, the health and performance of one or more components (e.g., valves 285, motors 262, pumps 261, the processing system 295, the power sources 265, the cooling fluid sources 228, the piping 288, the inflow lines 252, the outflow lines 253, the thermal transfer devices 241) of the subsea heat removal system 245. The component evaluation module 341 may use values associated with measurements of one or more parameters made by one or more sensor devices 260 to evaluate any of the components of the subsea heat removal system 245. Examples of such parameters may include, but are not limited to, flow rates, pressures, current, voltages, and temperatures. The component evaluation module 341 may use one or more protocols 332 and/or one or more algorithms 333 to perform any of its evaluations.

The cooling fluid evaluation module 343 of the controller 204 of the example subsea heat removal system 245 may be configured to evaluate, in real time, the composition and effectiveness of the cooling fluid 227 of the subsea heat removal system 245. The cooling fluid evaluation module 343 may use values associated with measurements of one or more parameters made by one or more sensor devices 260 to evaluate the cooling fluid 227. Examples of such parameters may include, but are not limited to, flow rates, pressures, chemical composition, viscosity, and temperatures. The cooling fluid evaluation module 343 may use one or more protocols 332 and/or one or more algorithms 333 to perform any of its evaluations.

The recommendation module 342 of the controller 204 of the example subsea heat removal system 245 may be configured to recommend actions to be taken (e.g., perform maintenance on a component of the subsea heat removal system 245 ahead of schedule, adjust a setting on a valve 285 or a component of the processing system 295, add a processing step as the cooling fluid 227 flows through the processing system 295) based on the cooling fluid evaluation module 343 evaluating the cooling fluid 227 and/or the component evaluation module 341 evaluating the components of the subsea heat removal system 245. The recommendation module 342 may use one or more protocols 332, one or more algorithms 333, and/or stored data 334 to perform any of its functions.

The communication module 307 of the controller 204 determines and implements the communication protocol (e.g., from the protocols 332 of the storage repository 331) that is used when the control engine 306 communicates with (e.g., sends signals to, obtains signals from) the user systems 255, the other controllers 204, the sensor devices 260, the network manager 280, and any other components of the field system 200, including other components of the subsea heat removal system 245. In some cases, the communication module 307 accesses the stored data 334 to determine which communication protocol is used to communicate with another component of the field system 200, including other components of the subsea heat removal system 245. In addition, the communication module 307 may identify and/or interpret the communication protocol of a communication obtained by the controller 204 so that the control engine 306 may interpret the communication. The communication module 307 may also provide one or more of a number of other services with respect to data sent from and obtained by the controller 204. Such services may include, but are not limited to, data packet routing information and procedures to follow in the event of data interruption.

The timer 335 of the controller 204 may track clock time, intervals of time, an amount of time, and/or any other measure of time. The timer 335 may also count the number of occurrences of an event, whether with or without respect to time. Alternatively, the control engine 306 may perform a counting function. The timer 335 is able to track multiple time measurements and/or count multiple occurrences concurrently. The timer 335 may track time periods based on an instruction obtained from the control engine 306, based on an instruction obtained from a user 251, based on an instruction programmed in the software for the controller 204, based on some other condition (e.g., the occurrence of an event) or from some other component, or from any combination thereof. In certain example embodiments, the timer 335 may provide a time stamp for each packet of data obtained from another component (e.g., a sensor device 260) of the example subsea heat removal system 245.

The power module 330 of the controller 204 may be configured to obtain power from a power source (e.g., power source 265-1) and manipulate (e.g., transforms, rectifies, inverts) that power to provide the manipulated power to one or more other components (e.g., the timer 335, the control engine 306) of the controller 204, where the manipulated power is of a type (e.g., alternating current, direct current) and level (e.g., 12V, 24V, 120V) that may be used by the other components of the controller 204. In some cases, the power module 330 may also provide power to one or more of the sensor devices 260 of the example subsea heat removal system 245.

The power module 330 may include one or more of a number of single or multiple discrete components (e.g., transistor, diode, resistor, transformer) and/or a microprocessor. The power module 330 may include a printed circuit board, upon which the microprocessor and/or one or more discrete components are positioned. In addition, or in the alternative, the power module 330 may be a source of power in itself to provide power and/or signals to the other components of the controller 204. For example, the power module 330 may be or include an energy storage device (e.g., a battery). As another example, the power module 330 may be or include a localized tidal power generation system.

The hardware processor 321 of the controller 204 executes software, algorithms (e.g., algorithms 333), and firmware in accordance with one or more example embodiments. Specifically, the hardware processor 321 may execute software on the control engine 306 or any other portion of the controller 204, as well as software used by the users 251 (including associated user systems 255), the other controllers 204, the network manager 280, and/or other components of the field system 200, including other components of components of the subsea heat removal system 245. The hardware processor 321 may be an integrated circuit, a central processing unit, a multi-core processing chip, SoC, a multi-chip module including multiple multi-core processing chips, or other hardware processor in one or more example embodiments. The hardware processor 321 may be known by other names, including but not limited to a computer processor, a microprocessor, and a multi-core processor.

In one or more example embodiments, the hardware processor 321 executes software instructions stored in memory 322. The memory 322 includes one or more cache memories, main memory, and/or any other suitable type of memory. The memory 322 may include volatile and/or non-volatile memory. The memory 322 may be discretely located within the controller 204 relative to the hardware processor 321. In certain configurations, the memory 322 may be integrated with the hardware processor 321.

In certain example embodiments, the controller 204 does not include a hardware processor 321. In such a case, the controller 204 may include, as an example, one or more field programmable gate arrays (FPGA), one or more insulated-gate bipolar transistors (IGBTs), and/or one or more integrated circuits (ICs). Using FPGAs, IGBTs, ICs, and/or other similar devices known in the art allows the controller 204 (or portions thereof) to be programmable and function according to certain logic rules and thresholds without the use of a hardware processor. Alternatively, FPGAs, IGBTs, ICs, and/or similar devices may be used in conjunction with one or more hardware processors 321.

The transceiver 324 of the controller 204 may send and/or obtain control and/or communication signals. Specifically, the transceiver 324 may be used to transfer data between the controller 204 and the users 251 (including associated user systems 255), the other controllers 204, the sensor devices 260, the network manager 280, and any other components of the field system 200, including other components of components of the subsea heat removal system 245. The transceiver 324 may use wired and/or wireless technology. The transceiver 324 may be configured in such a way that the control and/or communication signals sent and/or obtained by the transceiver 324 may be obtained and/or sent by another transceiver that is part of a user system 255, another controller 204, a sensor device 260, the network manager 280, and/or another component of the field system 200, including another of components of the subsea heat removal system 245. The transceiver 324 may send and/or obtain any of a number of signal types, including but not limited to radio frequency signals, infrared signals, ultrasonic signals, radar signals, and SONAR signals.

When the transceiver 324 uses wireless technology, any type of wireless technology may be used by the transceiver 324 in sending and obtaining signals. Such wireless technology may include, but is not limited to, Wi-Fi, Zigbee, VLC, cellular networking, BLE, UWB, and Bluetooth. The transceiver 324 may use one or more of any number of suitable communication protocols (e.g., ISA100, HART) when sending and/or obtaining signals.

Optionally, in one or more example embodiments, the security module 323 secures interactions between the controller 204, the users 251 (including associated user systems 255), the other controllers 204, the sensor devices 260, the network manager 280, and any other components of the field system 200, including other components of the subsea heat removal system 245. More specifically, the security module 323 authenticates communication from software based on security keys verifying the identity of the source of the communication. For example, user software may be associated with a security key enabling the software of a user system 255 to interact with the controller 204. Further, the security module 323 may restrict receipt of information, requests for information, and/or access to information.

A user 251 (including an associated user system 255), the other controllers 204, the sensor devices 260, the network manager 280, and the other components of the field system 200, including other components of the subsea heat removal system 245, may interact with the controller 204 using the application interface 326. Specifically, the application interface 326 of the controller 204 obtains data (e.g., information, communications, instructions, updates to firmware) from and sends data (e.g., information, communications, instructions) to the user systems 255 of the users 251, the other controllers 204, the sensor devices 260, the network manager 280, and/or the other components of the field system 200, including other components of the subsea heat removal system 245.

Examples of an application interface 326 may be or include, but are not limited to, an application programming interface, a web service, a data protocol adapter, some other hardware and/or software, or any suitable combination thereof. Similarly, the user systems 255 of the users 251, the other controllers 204, the sensor devices 260, the network manager 280, and/or the other components of the field system 200, including other components of the subsea heat removal system 245, may include an interface (similar to the application interface 326 of the controller 204) to obtain data from and send data to the controller 204 in certain example embodiments.

In addition, as discussed above with respect to a user system 255 of a user 251, one or more of the controllers 204, one or more of the sensor devices 260, the network manager 280, and/or one or more of the other components of the field system 200, including other components of the subsea heat removal system 245, may include a user interface. Examples of such a user interface may include, but are not limited to, a graphical user interface, a touchscreen, a keyboard, a monitor, a mouse, some other hardware, or any suitable combination thereof.

The controllers 204, the users 251 (including associated user systems 255), the sensor devices 260, the network manager 280, and the other components of the field system 200, including other components of the subsea heat removal system 245, may use their own system or share a system in certain example embodiments. Such a system may be, or contain a form of, an Internet-based or an intranet-based computer system that is capable of communicating with various software. A computer system includes any type of computing device and/or communication device, including but not limited to the controller 204. Examples of such a system may include, but are not limited to, a desktop computer with a Local Area Network (LAN), a Wide Area Network (WAN), Internet or intranet access, a laptop computer with LAN, WAN, Internet or intranet access, a smart phone, a server, a server farm, an android device (or equivalent), a tablet, smartphones, and a personal digital assistant (PDA). Such a system may correspond to a computer system as described below with regard to FIG. 4.

Further, as discussed above, such a system may have corresponding software (e.g., user system software, sensor device software, controller software). The software may execute on the same or a separate device (e.g., a server, mainframe, desktop personal computer (PC), laptop, PDA, television, cable box, satellite box, kiosk, telephone, mobile phone, or other computing devices) and may be coupled by the communication network (e.g., Internet, Intranet, Extranet, LAN, WAN, or other network communication methods) and/or communication channels, with wire and/or wireless segments according to some example embodiments. The software of one system may be a part of, or operate separately but in conjunction with, the software of another system within and/or outside of the field system 200.

Figure 4:
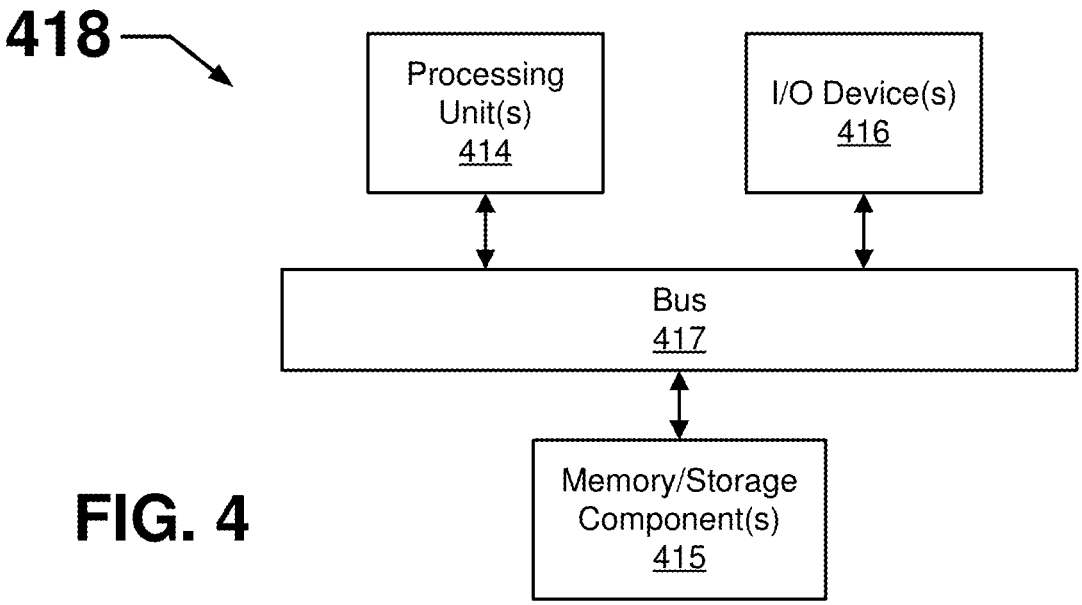
FIG. 4 shows a block diagram of a computing device according to certain example embodiments.

FIG. 4 shows a block diagram of a computing device 418 according to certain example embodiments. Specifically, FIG. 4 illustrates one embodiment of a computing device 418 that implements one or more of the various techniques described herein, and which is representative, in whole or in part, of the elements described herein pursuant to certain example embodiments. For example, a controller 204 (including components thereof, such as a control engine 306, a hardware processor 321, a storage repository 331, a power module 330, and a transceiver 324) may be considered a computing device 418. Computing device 418 is one example of a computing device and is not intended to suggest any limitation as to scope of use or functionality of the computing device and/or its possible architectures. Neither should the computing device 418 be interpreted as having any dependency or requirement relating to any one or combination of components illustrated in the example computing device 418.

The computing device 418 includes one or more processors or processing units 414, one or more memory/storage components 415, one or more input/output (I/O) devices 416, and a bus 417 that allows the various components and devices to communicate with one another. The bus 417 represents one or more of any of several types of bus structures, including a memory bus or memory controller, a peripheral bus, an accelerated graphics port, and a processor or local bus using any of a variety of bus architectures. The bus 417 includes wired and/or wireless buses.

The memory/storage component 415 represents one or more computer storage media. The memory/storage component 415 includes volatile media (such as random access memory (RAM)) and/or nonvolatile media (such as read only memory (ROM), flash memory, optical disks, magnetic disks, and so forth). The memory/storage component 415 includes fixed media (e.g., RAM, ROM, a fixed hard drive, etc.) as well as removable media (e.g., a Flash memory drive, a removable hard drive, an optical disk, and so forth).

One or more I/O devices 416 allow a user 251 to enter commands and information to the computing device 418, and also allow information to be presented to the user 251 and/or other components or devices. Examples of input devices 416 include, but are not limited to, a keyboard, a cursor control device (e.g., a mouse), a microphone, a touchscreen, and a scanner. Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques is stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 418 (also sometimes called a computer system herein) is connected to a network (not shown) (e.g., a LAN, a WAN such as the Internet, cloud, or any other similar type of network) via a network interface connection (not shown) according to some example embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other example embodiments. Generally speaking, the computer device 418 includes at least the minimal processing, input, and/or output means necessary to practice one or more embodiments.

Further, those skilled in the art will appreciate that one or more elements of the aforementioned computer device 418 is located at a remote location and connected to the other elements over a network in certain example embodiments. Further, one or more embodiments are implemented on a distributed system having one or more nodes, where each portion of the implementation (e.g., the subsea heat removal system 245) is located on a different node within the distributed system. In one or more embodiments, the node corresponds to a computer system. Alternatively, the node corresponds to a processor with associated physical memory in some example embodiments. The node alternatively corresponds to a processor with shared memory and/or resources in some example embodiments.

Figure 5:
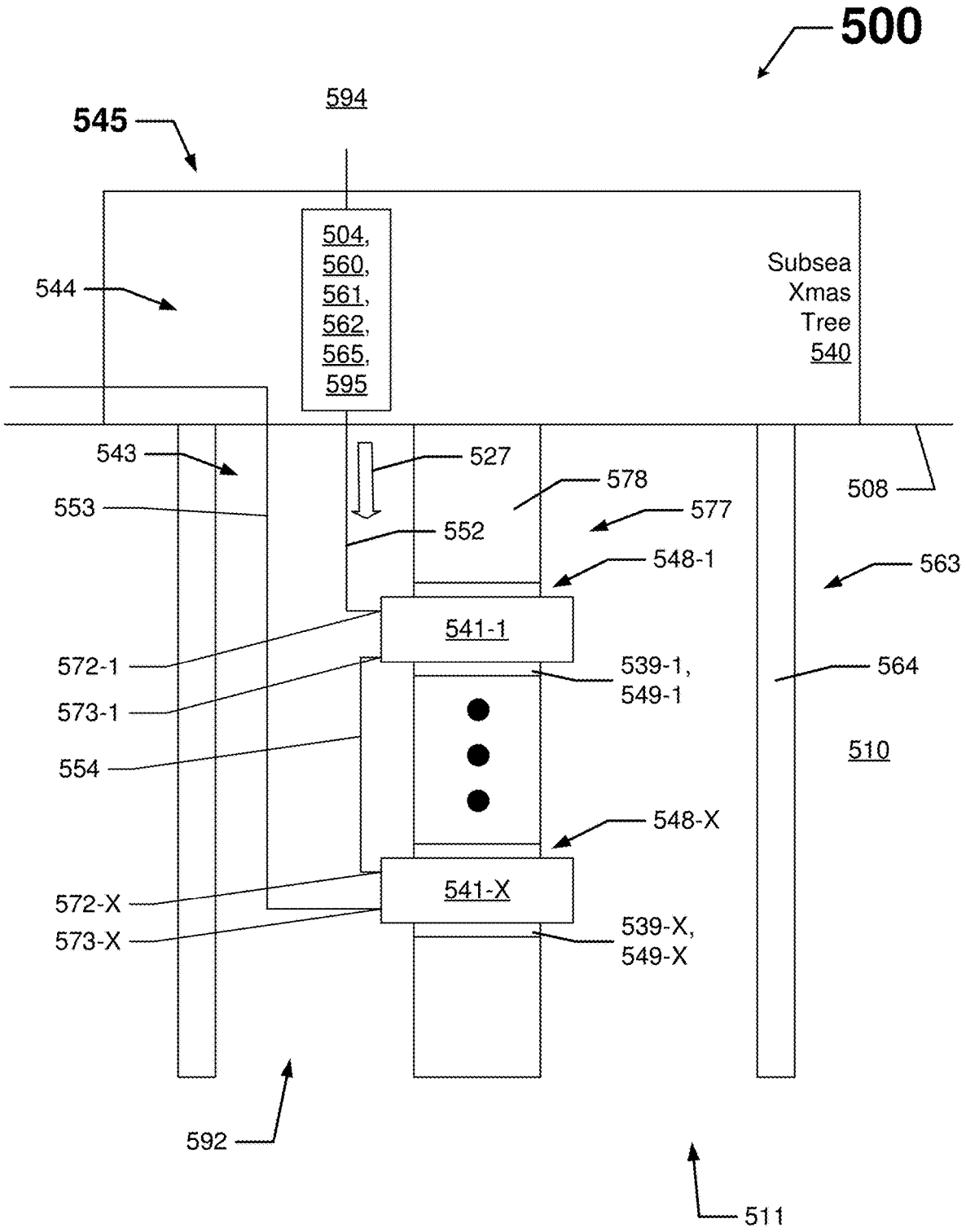
FIG. 5 shows a sectional view of a field system that includes a subsea heat removal system according to certain example embodiments.

FIG. 5 shows a sectional view of a field system 500 that includes a subsea heat removal system 545 according to certain example embodiments. Referring to the description above with respect to FIGS. 1 through 4, the field system 500 of FIG. 5 shows a wellbore 511 drilled into a subterranean formation 510. A casing string 563 having a number of casing pipes 564 coupled to each other end to end is positioned within the wellbore 511 and set against the wall of the wellbore 511 with cement. The wall (e.g., wall 109) and the cement (e.g., cement 119) shown in the field system 100 of FIG. 1 are omitted in FIG. 5 to help simplify the drawing. The seabed 508 may be some distance (e.g., hundreds of feet, thousands of feet, miles) below the water line of the water 594.

A tubing string 577 is also positioned within the wellbore 511 inside of the casing string 563. The space between the tubing string 577 and the casing string 563 in the wellbore 511 is the annulus 592. The tubing string 577 in this example includes X (e.g., 1, 2, 3, 5, 10) subs 548 (sub 548-1 through sub 548-X) and a number of tubing pipes 578 that are coupled to each other end-to-end to form the tubing string 577. In other words, the field system 500 may have a single sub 548 or multiple subs 548. Each sub 548 includes a body 549 (e.g., body 549-1 for sub 548-1, body 549-X for sub 548-X) and an electrical device 539 (e.g., electrical device 539-1 for sub 548-1, electrical device 539-X for sub 548-X). The body 549 of a sub 548 can have a wall that forms a cavity, inside of which is disposed the electrical device 539. The cavity of the body 549 of a sub 548 coincides with the cavity of the rest of the tubing string 577.

While not shown in FIG. 5 to simplify the drawing, the electrical device 539 of each sub 548 operates by receiving power and/or control signals from a power source (e.g., similar to power source 165) at or near the seabed 508 (e.g., integrated with the subsea Xmas tree 540) via power transfer links (e.g., similar to power transfer links 187) and/or communication links (e.g., similar to communication links 105), respectively. As discussed above, as each electrical device 539 operates, the electrical device 539 heats up. Also not shown in FIG. 5 in order to simply the drawing are any packers (e.g., similar to packer 166 of FIG. 1) that are used to isolate an environment (e.g., a pressure, a fluid) within the annulus 592 on each side of the packer and prevent fluidic communication therethrough.

The field system 500 of FIG. 5 also includes a subsea Xmas tree 540 (substantially similar to the subsea Xmas tree 140 of FIG. 1) that is mounted at the entry point (e.g., atop a wellhead) of the wellbore 511. In this example, the subsea Xmas tree 540 includes multiple seabed components 544 of an example subsea heat removal system 545. Specifically, the subsea Xmas tree 540 of FIG. 5 includes a controller 504, a sensor device 560, a pump 561, a motor 562, a power source 565, and a processing system 595, all of which are substantially similar to the corresponding seabed components of the subsea heat removal systems discussed above with respect to FIGS. 1 through 3.

The power source 565 (or in some cases another power source 565) that is integrated with the subsea Xmas tree 540 (or comes from other location (e.g., a generator on the topsides of a platform floating in the water 694, a transformer positioned at or near the seabed 508)) is configured to provide power and/or control signals to the electrical devices 539 of the subs 548 (electrical device 539-1 of the sub 548-1 through the electrical device 539-X of the sub 548-X) via power transfer links (not shown in FIG. 5 to simplify the drawing, but substantially similar to the power transfer links 187 of FIG. 1 above) and/or communication links (not shown in FIG. 5 to simplify the drawing, but substantially similar to the communication links 105 of FIG. 1 above) in the form of one or more electrical cables that are positioned in the annulus 592.

The subsea heat removal system 545 of FIG. 5 also includes wellbore components 543 that include an inflow line 552, X (e.g., 1, 2, 3, 5, 10) thermal transfer devices 541 (thermal transfer device 541-1 through thermal transfer device 541-X), one or more optional intermediate flow lines 554, and an outflow line 553 through which cooling fluid 527 flows. The inflow line 552, the one or more thermal transfer devices 541, and the outflow line 553 are substantially similar to the corresponding wellbore components of the subsea heat removal systems discussed above with respect to FIGS. 1 through 3. The inflow line 552 is configured to allow the cooling fluid 527 to flow from a component (e.g., the pump 561) of the seabed components 544 of the subsea heat removal system 545 to the thermal transfer device 541-1. Part of the inflow line 552 (e.g., a proximal end or an inflow line proximal end) is positioned above the seabed 508 (e.g., in the water 594), and a remainder (e.g., a majority) of the inflow line 552 (e.g., a distal end or an inflow line distal end) is positioned in the annulus 592 in the wellbore 511.

The thermal transfer device 541-1 is configured to absorb some of the heat generated by the electrical device 539-1 of the sub 548-1 and transfer this heat to the cooling fluid 527 that flows therethrough. The thermal transfer device 541-1 is made of or includes a thermally conductive material and is in thermal communication with the electrical device 539-1 of the sub 548-1 located in the wellbore 511. This allows heat from the electrical device 539-1 to be transferred to the thermal transfer device 541-1. In any case, the thermal transfer device 541-1 includes an inlet 572-1 and an outlet 573-1. The inlet 572-1 is configured to connect to an end (e.g., a distal end) of the inflow line 552 (sometimes referred to as an inflow line distal end herein). When the inflow line 552 is connected to the inlet 572-1 of the thermal transfer device 541-1, the inlet 572-1 is configured to receive the cooling fluid 527 pumped down by the seabed components 544 of the subsea heat removal system 545. The cooling fluid 527 then flows through the thermal transfer device 541-1 and absorbs some of the heat that has been transferred to the thermal transfer device 541-1 by the electrical device 539-1.

The cooling fluid 527 that enters the inlet 572-1 of the thermal transfer device 541-1 exits the outlet 573-1 of the thermal transfer device 541-1 as a heated version of the cooling fluid 527. The outlet 573-1 is configured to connect to an end of a flow line. If the thermal transfer device 541-1 is the only thermal transfer device among the wellbore components 543 of the subsea heat removal system 545, the outlet 573-1 connects to an end (e.g., a distal end) of the outflow line 553 (sometimes referred to as an outflow line distal end herein). In such a case, when the outflow line 553 is connected to the outlet 573-1 of the thermal transfer device 541-1, the outlet 573-1 is configured to deliver the heated version of the cooling fluid 527 from the thermal transfer device 541-1 to the outflow line 553 so that the heated version of the cooling fluid 527 returns above the seabed 508.

Alternatively, as shown in FIG. 5, if the thermal transfer device 541-1 is among multiple (e.g., X) thermal transfer devices 541, the outlet 573-1 is connected to an end (e.g., a distal end) of an intermediate line 554. When the intermediate line 554 is connected to the outlet 573-1 of the thermal transfer device 541-1, the outlet 573-1 is configured to deliver the heated version of the cooling fluid 527 from the thermal transfer device 541-1 to the intermediate line 554 so that the heated version of the cooling fluid 527 flows to the next thermal transfer device 541 (e.g., thermal transfer device 541-X).

The intermediate line 554 is a medium (e.g., a tube, a flow line) through which a heated version of the cooling fluid 527 flows. Specifically, the intermediate line 554 is configured to allow the heated version of the cooling fluid 527 to flow from the thermal transfer device 541-1 to the inlet 572 (e.g., inlet 572-X) of another thermal transfer device 541 (e.g., thermal transfer device 541-X). The intermediate line 554 may be rigid and/or flexible. The intermediate line 554 may be made of a thermally insulating material and/or a thermally conductive material. All of the intermediate line 554 is positioned in the annulus 592 in the wellbore 511.

Continuing with this example where the example subsea heat removal system 545 provides cooling fluid 527 to multiple electrical devices 539, if there are only two electrical devices 539, the heated version of the cooling fluid 527 flows through the intermediate line 554 from the outlet 573-1 of the thermal transfer device 541-1 to the inlet 572-X of the thermal transfer device 541-X. The inlet 572-X is configured to connect to an end (e.g., a distal end) of the intermediate line 554 (sometimes referred to as an intermediate line distal end herein). The thermal transfer device 541-X is configured to absorb some of the heat generated by the electrical device 539-X of the sub 548-X and transfer this heat to the heated version of the cooling fluid 527 that flows therethrough. The even more heated version of the cooling fluid 527 than exits the thermal transfer device 541-X through the outlet 573-X, which is connected to the outflow line 553. The even more heated version of the cooling fluid 527 then flows through to the outflow line 553 above the seabed 508.

If there are three or more electrical devices 539, then there may be multiple intermediate lines 554 that allow the cooling fluid 527 to flow through the various thermal transfer devices 541 in series within the annulus 592. In any case, the example subsea heat removal system 545 of FIG. 5 is configured as an open-loop system. In this way, the water 594 (e.g., the ocean) is considered to be the cooling fluid source 228 described above in FIG. 2. As a result, regardless of how many electrical devices 539 are in the field system 500, when the heated version of the cooling fluid 527 flows through the outlet 573 of the last thermal transfer device 541 in the series and returns above the seabed 508 through the outflow line 553, the heated version of the cooling fluid 527 flows out the end (e.g., the proximal end) of the outflow line 553 into the water 594.

Similarly, the cooling fluid 527 that flows through the inflow line 552 into the annulus 592 and through the one or more thermal transfer devices 541 is taken from the water 594 (e.g., having a temperature of 35° F. to 40° F.). In such case, the end of the inflow line 552 that intakes the water 594 as cooling fluid 527 and the end of the outflow line 553 that expels the heated version of the cooling fluid 527 into the water 594 may be located separately from each other so that the heated version of the cooling fluid 527 being returned to the water 594 does not unnecessarily heat the water 594 taken in as cooling fluid 527. Also, the processing system 595 of the subsea heat removal system 545 may include a filter (similar to the filter 289 discussed above) to remove sediment, sand, and other debris that may be stirred up from the seabed 508 by natural currents, the expulsion of the heated version of the cooling fluid 527 from the outflow line 553, and/or other factors (e.g., the operation of other equipment on the subsea Xmas tree 540).

Figure 6:
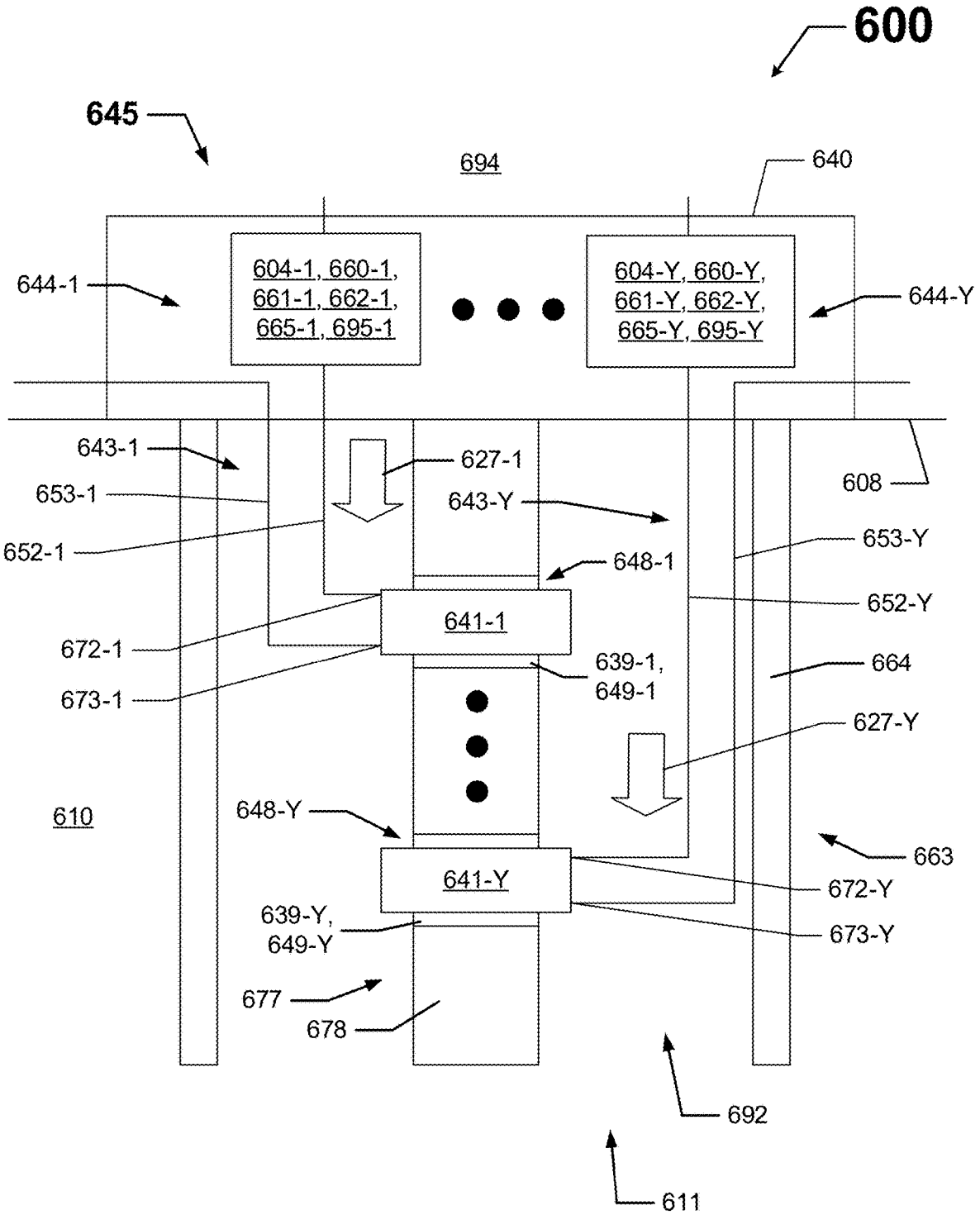
FIG. 6 shows a sectional view of another field system that includes a subsea heat removal system according to certain example embodiments.

FIG. 6 shows a sectional view of another field system 600 that includes a subsea heat removal system 645 according to certain example embodiments. Referring to the description above with respect to FIGS. 1 through 5, the field system 600 of FIG. 6 shows a wellbore 611 drilled into a subterranean formation 610. A casing string 663 having a number of casing pipes 664 coupled to each other end to end is positioned within the wellbore 611 and set against the wall of the wellbore 611 with cement. The wall (e.g., wall 109) and the cement (e.g., cement 119) shown in the field system 100 of FIG. 1 are omitted in FIG. 6 to help simplify the drawing. The seabed 608 may be some distance (e.g., hundreds of feet, thousands of feet, miles) below the water line of the water 694.

A tubing string 677 is also positioned within the wellbore 611 inside of the casing string 663. The space between the tubing string 677 and the casing string 663 in the wellbore 611 is the annulus 692. The tubing string 677 in this example includes Y (e.g., 2, 3, 5, 10) subs 648 (sub 648-1 through sub 648-Y) and a number of tubing pipes 678 that are coupled to each other end-to-end to form the tubing string 677. In other words, the field system 600 may have a single sub 648 or multiple subs 648. Each sub 648 includes a body 649 (e.g., body 649-1 for sub 648-1, body 649-Y for sub 648-Y) and an electrical device 639 (e.g., electrical device 639-1 for sub 648-1, electrical device 639-Y for sub 648-Y). The body 649 of a sub 648 can have a wall that forms a cavity, inside of which is disposed the electrical device 639. The cavity of the body 649 of a sub 648 coincides with the cavity of the rest of the tubing string 677.

While not shown in FIG. 6 to simplify the drawing, the electrical device 639 of each sub 648 operates by receiving power and/or control signals from a power source (e.g., similar to power source 165) at or near the seabed 608 (e.g., integrated with the subsea Xmas tree 640) via power transfer links (e.g., similar to power transfer links 187) and/or communication links (e.g., similar to communication links 105), respectively. As discussed above, as each electrical device 639 operates, the electrical device 639 heats up. Also not shown in FIG. 6 in order to simply the drawing are any packers (e.g., similar to packer 166 of FIG. 1) that are used to isolate an environment (e.g., a pressure, a fluid) within the annulus 692 on each side of the packer and prevent fluidic communication therethrough.

The field system 600 of FIG. 6 also includes a subsea Xmas tree 640 (substantially similar to the subsea Xmas tree 140 of FIG. 1) that is mounted at the entry point (e.g., atop a wellhead) of the wellbore 611. The subsea Xmas tree 640 includes multiple (e.g., 2, 3, 5, 10) subsea heat removal systems 645. In this case, there are Y subsea heat removal systems 645 (subsea heat removal system 645-1 through subsea heat removal system 645-Y). Each subsea heat removal system 645 includes multiple seabed components 644. Specifically, the seabed components 644-1 of the subsea heat removal system 645-1 that are mounted on and/or integrated with the subsea Xmas tree 640 of FIG. 6 includes a controller 604-1, a sensor device 660-1, a pump 661-1, a motor 662-1, a power source 665-1, and a processing system 695-1.

Similarly, the seabed components 644-Y of the subsea heat removal system 645-Y that are mounted on and/or integrated with the subsea Xmas tree 640 of FIG. 6 includes a controller 604-Y, a sensor device 660-Y, a pump 661-Y, a motor 662-Y, a power source 665-Y, and a processing system 695-Y. The controllers 604, the sensor devices 660, the pumps 661, the motors 662, the power sources 665, and the processing systems 695 of FIG. 6 are substantially similar to the corresponding seabed components of the subsea heat removal systems discussed above with respect to FIGS. 1 through 3.

A power source 665 that is integrated with the subsea Xmas tree 640 or comes from other location (e.g., a generator on the topsides of a platform floating in the water 694, a transformer positioned at or near the seabed 608) is configured to provide power and/or control signals to the electrical devices 639 of the subs 648 (electrical device 639-1 of the sub 648-1 through the electrical device 639-Y of the sub 648-Y) via power transfer links (not shown in FIG. 6 to simplify the drawing, but substantially similar to the power transfer links 187 of FIG. 1 above) and/or communication links (not shown in FIG. 6 to simplify the drawing, but substantially similar to the communication links 105 of FIG. 1 above) in the form of one or more electrical cables that are positioned in the annulus 692.

Each subsea heat removal system 645 of FIG. 6 also includes multiple wellbore components 643. For example, the wellbore components 643-1 of the subsea heat removal system 645-1 include an inflow line 652-1, a thermal transfer device 641-1, and an outflow line 653-1 through which cooling fluid 627-1 flows. Similarly, the wellbore components 643-Y of the subsea heat removal system 645-Y include an inflow line 652-Y, a thermal transfer device 641-Y, and an outflow line 653-Y through which cooling fluid 627-Y flows. The inflow lines 652, the thermal transfer devices 641, and the outflow lines 653 are substantially similar to the corresponding wellbore components of the subsea heat removal systems discussed above with respect to FIGS. 1 through 3.

For the subsea heat removal system 645-1, the inflow line 652-1 is configured to allow the cooling fluid 627-1 to flow from a component (e.g., the pump 661-1) of the seabed components 644-1 of the subsea heat removal system 645-1 to the thermal transfer device 641-1. Part of the inflow line 652-1 (e.g., a proximal end or an inflow line proximal end) is positioned above the seabed 608 (e.g., in the water 694), and a remainder (e.g., a majority) of the inflow line 652-1 (e.g., a distal end or an inflow line distal end) is positioned in the annulus 692 in the wellbore 611.

The thermal transfer device 641-1 of the subsea heat removal system 645-1 is configured to absorb some of the heat generated by the electrical device 639-1 of the sub 648-1 and transfer this heat to the cooling fluid 627-1 that flows therethrough. The thermal transfer device 641-1 is made of or includes a thermally conductive material and is in thermal communication with the electrical device 639-1 of the sub 648-1 located in the wellbore 611. This allows heat from the electrical device 639-1 to be transferred to the thermal transfer device 641-1.

The thermal transfer device 641-1 includes an inlet 672-1 and an outlet 673-1. The inlet 672-1 is configured to connect to an end (e.g., a distal end) of the inflow line 652-1 (sometimes referred to as an inflow line distal end herein). When the inflow line 652-1 is connected to the inlet 672-1 of the thermal transfer device 641-1, the inlet 672-1 is configured to receive the cooling fluid 627-1 pumped down by the seabed components 644-1 of the subsea heat removal system 645-1. The cooling fluid 627-1 then flows through the thermal transfer device 641-1 and absorbs some of the heat that has been transferred to the thermal transfer device 641-1 by the electrical device 639-1.

The cooling fluid 627-1 that enters the inlet 672-1 of the thermal transfer device 641-1 exits the outlet 673-1 of the thermal transfer device 641-1 as a heated version of the cooling fluid 627-1. The outlet 673-1 is configured to connect to an end (e.g., a distal end) of the outflow line 653-1, which delivers the heated version of the cooling fluid 627-1 above the seabed 608. Since the subsea heat removal system 645-1 in this case is an open loop system, the heated version of the cooling fluid 627-1 flows out the other end (e.g., the proximal end) of the outflow line 653-1 into the water 694. In this way, the water 694 (e.g., the ocean having a temperature of 35° F. to 40° F.) is considered to be the cooling fluid source 228 described above in FIG. 2.

Similarly, the cooling fluid 627-1 that flows through the inflow line 652-1 into the annulus 692 and through the thermal transfer device 641-1 is taken from the water 694. In such a case, the end of the inflow line 652-1 that intakes the water 694 as cooling fluid 627-1 and the end of the outflow line 653-1 that expels the heated version of the cooling fluid 627-1 into the water 694 may be located separately from each other so that the heated version of the cooling fluid 627-1 being returned to the water 694 does not unnecessarily heat the water 694 taken in as cooling fluid 627-1. Also, the processing system 695-1 of the subsea heat removal system 645-1 may include a filter (similar to the filter 289 discussed above) to remove sediment, sand, and other debris that may be stirred up from the seabed 608 by natural currents, the expulsion of the heated version of the cooling fluid 627-1 from the outflow line 653-1, and/or other factors (e.g., the operation of other equipment on the subsea Xmas tree 640).

For the subsea heat removal system 645-Y, the inflow line 652-Y is configured to allow the cooling fluid 627-Y to flow from a component (e.g., the pump 661-Y) of the seabed components 644-Y of the subsea heat removal system 645-Y to the thermal transfer device 641-Y. Part of the inflow line 652-Y (e.g., a proximal end or an inflow line proximal end) is positioned above the seabed 608 (e.g., in the water 694), and a remainder (e.g., a majority) of the inflow line 652-Y (e.g., a distal end or an inflow line distal end) is positioned in the annulus 692 in the wellbore 611.

The thermal transfer device 641-Y of the subsea heat removal system 645-Y is configured to absorb some of the heat generated by the electrical device 639-Y of the sub 648-Y and transfer this heat to the cooling fluid 627-Y that flows therethrough. The thermal transfer device 641-Y is made of or includes a thermally conductive material and is in thermal communication with the electrical device 639-Y of the sub 648-Y located in the wellbore 611. This allows heat from the electrical device 639-Y to be transferred to the thermal transfer device 641-Y.

The thermal transfer device 641-Y includes an inlet 672-Y and an outlet 673-Y. The inlet 672-Y is configured to connect to an end (e.g., a distal end) of the inflow line 652-Y (sometimes referred to as an inflow line distal end herein). When the inflow line 652-Y is connected to the inlet 672-Y of the thermal transfer device 641-Y, the inlet 672-Y is configured to receive the cooling fluid 627-Y pumped down by the seabed components 644-Y of the subsea heat removal system 645-Y. The cooling fluid 627-Y then flows through the thermal transfer device 641-Y and absorbs some of the heat that has been transferred to the thermal transfer device 641-Y by the electrical device 639-Y.

The cooling fluid 627-Y that enters the inlet 672-Y of the thermal transfer device 641-Y exits the outlet 673-Y of the thermal transfer device 641-Y as a heated version of the cooling fluid 627-Y. The outlet 673-Y is configured to connect to an end (e.g., a distal end) of the outflow line 653-Y, which delivers the heated version of the cooling fluid 627-Y above the seabed 608. Since the subsea heat removal system 645-Y in this case is an open loop system, the heated version of the cooling fluid 627-Y flows out the other end (e.g., the proximal end) of the outflow line 653-Y into the water 694. In this way, the water 694 (e.g., the ocean having a temperature of 35° F. to 40° F.) is considered to be the cooling fluid source 228 described above in FIG. 2.

Similarly, the cooling fluid 627-Y that flows through the inflow line 652-Y into the annulus 692 and through the thermal transfer device 641-Y is taken from the water 694. In such a case, the end of the inflow line 652-Y that intakes the water 694 as cooling fluid 627-Y and the end of the outflow line 653-Y that expels the heated version of the cooling fluid 627-Y into the water 694 may be located separately from each other so that the heated version of the cooling fluid 627-Y being returned to the water 694 does not unnecessarily heat the water 694 taken in as cooling fluid 627-Y. Also, the processing system 695-Y of the subsea heat removal system 645-Y may include a filter (similar to the filter 289 discussed above) to remove sediment, sand, and other debris that may be stirred up from the seabed 608 by natural currents, the expulsion of the heated version of the cooling fluid 627-Y from the outflow line 653-Y, and/or other factors (e.g., the operation of other equipment on the subsea Xmas tree 640).

Figure 7:
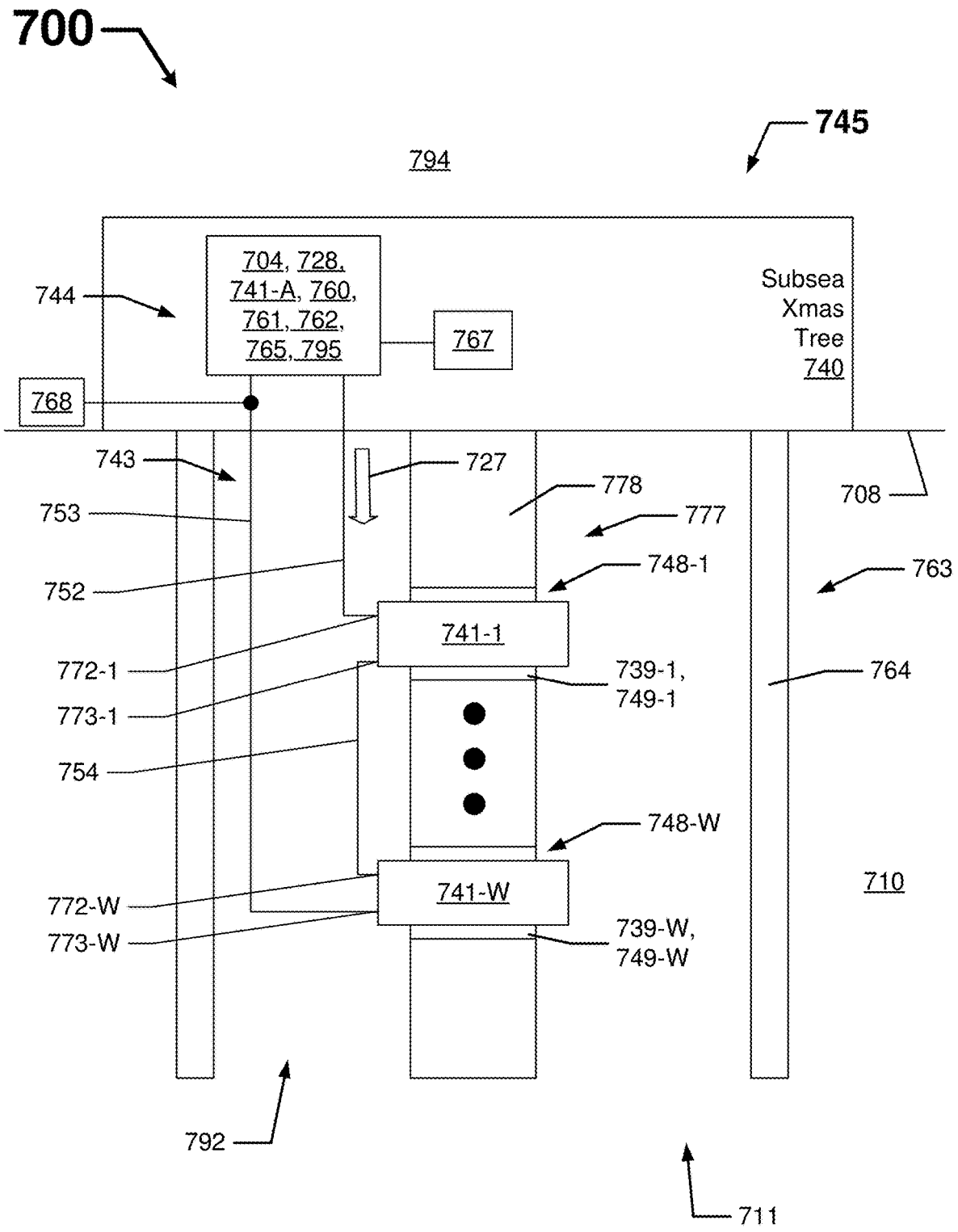
FIG. 7 shows a sectional view of a field system that includes multiple subsea heat removal systems according to certain example embodiments.

FIG. 7 shows a sectional view of a field system 700 that includes a subsea heat removal system 745 according to certain example embodiments. Referring to the description above with respect to FIGS. 1 through 6, the field system 700 of FIG. 7 shows a wellbore 711 drilled into a subterranean formation 710. A casing string 763 having a number of casing pipes 764 coupled to each other end to end is positioned within the wellbore 711 and set against the wall of the wellbore 711 with cement. The wall (e.g., wall 109) and the cement (e.g., cement 119) shown in the field system 100 of FIG. 1 are omitted in FIG. 7 to help simplify the drawing. The seabed 708 may be some distance (e.g., hundreds of feet, thousands of feet, miles) below the water line of the water 794.

A tubing string 777 is also positioned within the wellbore 711 inside of the casing string 763. The space between the tubing string 777 and the casing string 763 in the wellbore 711 is the annulus 792. The tubing string 777 in this example includes W (e.g., 1, 2, 3, 5, 10) subs 748 (sub 748-1 through sub 748-W) and a number of tubing pipes 778 that are coupled to each other end-to-end to form the tubing string 777. In other words, the field system 700 may have a single sub 748 or multiple subs 748. Each sub 748 includes a body 749 (e.g., body 749-1 for sub 748-1, body 749-W for sub 748-W) and an electrical device 639 (e.g., electrical device 639-1 for sub 648-1, electrical device 639-W for sub 648-W). The body 749 of a sub 748 can have a wall that forms a cavity, inside of which is disposed the electrical device 739. The cavity of the body 749 of a sub 748 coincides with the cavity of the rest of the tubing string 777.

While not shown in FIG. 7 to simplify the drawing, the electrical device 739 of each sub 748 operates by receiving power and/or control signals from a power source (e.g., similar to power source 165) at or near the seabed 708 (e.g., integrated with the subsea Xmas tree 740) via power transfer links (e.g., similar to power transfer links 187) and/or communication links (e.g., similar to communication links 105), respectively. As discussed above, as each electrical device 739 operates, the electrical device 739 heats up. Also not shown in FIG. 7 in order to simply the drawing are any packers (e.g., similar to packer 166 of FIG. 1) that are used to isolate an environment (e.g., a pressure, a fluid) within the annulus 792 on each side of the packer and prevent fluidic communication therethrough.

The field system 700 of FIG. 7 also includes a subsea Xmas tree 740 (substantially similar to the subsea Xmas tree 140 of FIG. 1) that is mounted at the entry point (e.g., atop a wellhead) of the wellbore 711. In this example, the subsea Xmas tree 740 includes multiple seabed components 744 of the example subsea heat removal system 745. Specifically, the subsea Xmas tree 740 of FIG. 7 includes a controller 704, a cooling fluid source 728, a thermal transfer device 741-A, a sensor device 760, a pump 761, a motor 762, a power source 765, and a processing system 795, all of which are substantially similar to the corresponding seabed components of the subsea heat removal systems discussed above with respect to FIGS. 1 through 3.

The power source 765 (or in some cases another power source 765) that is integrated with the subsea Xmas tree 740 (or comes from other location (e.g., a generator on the topsides of a platform floating in the water 694, a transformer positioned at or near the seabed 708)) is configured to provide power and/or control signals to the electrical devices 739 of the subs 748 (electrical device 739-1 of the sub 748-1 through the electrical device 739-W of the sub 748-W) via power transfer links (not shown in FIG. 7 to simplify the drawing, but substantially similar to the power transfer links 187 of FIG. 1 above) and/or communication links (not shown in FIG. 7 to simplify the drawing, but substantially similar to the communication links 105 of FIG.

1 above) in the form of one or more electrical cables that are positioned in the annulus 792.

The subsea heat removal system 745 of FIG. 7 also includes wellbore components 743 that include an inflow line 752, W (e.g., 1, 2, 3, 5, 10) thermal transfer devices 741 (thermal transfer device 741-1 through thermal transfer device 741-W), one or more optional intermediate flow lines 754, and an outflow line 753 through which cooling fluid 727 flows. The inflow line 752, the one or more thermal transfer devices 741, and the outflow line 753 are substantially similar to the corresponding wellbore components of the subsea heat removal systems discussed above with respect to FIGS. 1 through 3. The intermediate flow lines 754 are substantially similar to the intermediate flow lines 554 discussed above with respect to FIG. 5.

The inflow line 752 is configured to allow the cooling fluid 727 to flow from a component (e.g., the pump 761) of the seabed components 744 of the subsea heat removal system 745 to the thermal transfer device 741-1. Part of the inflow line 752 (e.g., a proximal end or an inflow line proximal end) is positioned above the seabed 708, and a remainder (e.g., a majority) of the inflow line 752 (e.g., a distal end or an inflow line distal end) is positioned in the annulus 792 in the wellbore 711.

The thermal transfer device 741-1 is configured to absorb some of the heat generated by the electrical device 739-1 of the sub 748-1 and transfer this heat to the cooling fluid 727 that flows therethrough. The thermal transfer device 741-1 is made of or includes a thermally conductive material and is in thermal communication with the electrical device 739-1 of the sub 748-1 located in the wellbore 711. This allows heat from the electrical device 739-1 to be transferred to the thermal transfer device 741-1, which includes an inlet 772-1 and an outlet 773-1. The inlet 772-1 is configured to connect to an end (e.g., a distal end) of the inflow line 752 (sometimes referred to as an inflow line distal end herein). When the inflow line 752 is connected to the inlet 772-1 of the thermal transfer device 741-1, the inlet 772-1 is configured to receive the cooling fluid 727 pumped down by the seabed components 744 of the subsea heat removal system 745. The cooling fluid 727 then flows through the thermal transfer device 741-1 and absorbs some of the heat that has been transferred to the thermal transfer device 741-1 by the electrical device 739-1.

The cooling fluid 727 that enters the inlet 772-1 of the thermal transfer device 741-1 exits the outlet 773-1 of the thermal transfer device 741-1 as a heated version of the cooling fluid 727. The outlet 773-1 is configured to connect to an end of a flow line. If the thermal transfer device 741-1 is the only thermal transfer device among the wellbore components 743 of the subsea heat removal system 745, the outlet 773-1 connects to an end (e.g., a distal end) of the outflow line 753 (sometimes referred to as an outflow line distal end herein). In such a case, when the outflow line 753 is connected to the outlet 773-1 of the thermal transfer device 741-1, the outlet 773-1 is configured to deliver the heated version of the cooling fluid 727 from the thermal transfer device 741-1 to the outflow line 753 so that the heated version of the cooling fluid 727 returns above the seabed 708.

Alternatively, as shown in FIG. 7, if the thermal transfer device 741-1 is among multiple (e.g., W) thermal transfer devices 741, the outlet 773-1 is connected to an end (e.g., a distal end) of an intermediate line 754. When the intermediate line 754 is connected to the outlet 773-1 of the thermal transfer device 741-1, the outlet 773-1 is configured to deliver the heated version of the cooling fluid 727 from the thermal transfer device 741-1 to the intermediate line 754 so that the heated version of the cooling fluid 727 flows to the next thermal transfer device 741 (e.g., thermal transfer device 741-W).

The intermediate line 754 is a medium (e.g., a tube, a flow line) through which a heated version of the cooling fluid 727 flows. Specifically, the intermediate line 754 is configured to allow the heated version of the cooling fluid 727 to flow from the thermal transfer device 741-1 to the inlet 772 (e.g., inlet 772-W) of another thermal transfer device 741 (e.g., thermal transfer device 741-W). If there are only two electrical devices 739, the heated version of the cooling fluid 727 flows through the intermediate line 754 from the outlet 773-1 of the thermal transfer device 741-1 to the inlet 772-W of the thermal transfer device 741-W. The inlet 772-W is configured to connect to an end (e.g., a distal end) of the intermediate line 754 (sometimes referred to as an intermediate line distal end herein). The thermal transfer device 741-W is configured to absorb some of the heat generated by the electrical device 739-W of the sub 748-W and transfer this heat to the heated version of the cooling fluid 727 that flows therethrough. The even more heated version of the cooling fluid 727 than exits the thermal transfer device 741-W through the outlet 773-W, which is connected to the outflow line 753. The even more heated version of the cooling fluid 727 then flows through to the outflow line 753 above the seabed 708.

If there are three or more electrical devices 739, then there may be multiple intermediate lines 754 that allow the cooling fluid 727 to flow through the various thermal transfer devices 741 in series within the annulus 792. In any case, the example subsea heat removal system 745 of FIG. 7 is configured as a closed-loop system. In this way, the heated version of the cooling fluid 727 flows through the thermal transfer device 741-A located above the seabed 708 so that some of the heat of the cooling fluid 727 is transferred to the thermal transfer device 741-A, which allows the cooling fluid 727 to be recycled back into the wellbore 711 through the wellbore components 743 at a relatively lower temperature. In this case, the thermal transfer device 741-A may be or include the outflow line 753 and/or piping (e.g., piping 288). At least some of the cooler temperature fluid used to remove heat from the cooling fluid 727 within the thermal transfer device 741-A is the water 794 (e.g., having a temperature of 35° F. to 40° F.).

In some cases, the subsea heat removal system 745 may include one or more additional components and/or features. For example, as shown in FIG. 7, the subsea heat removal system 745 includes a port 768 that is tied into the circulation system of the subsea heat removal system 745. In this case, the port 768 is tied into the outflow line 753. The port 768 may serve one or more of a number of functions. For example, the port 768 may allow a test probe (e.g., attached to a remotely operated vehicle (ROV) or similar underwater vehicle) to extract a sample of the cooling fluid 727 for testing and analysis. As another example, the port 768 may allow for a replenishing volume of cooling fluid 727 to be injected into the circulation system of a subsea heat removal system 745.

An example of another additional component and/or feature of the subsea heat removal system 745 is a storage tank 767 that may be tied into the circulation system of the subsea heat removal system 745. The release of the contents of the storage tank 767 may be regulated by one or more valves (e.g., similar to valves 285), which may be controlled by the controller 704. The storage tank 767 may have any of a number of different contents. For example, the storage tank 767 may contain additional cooling fluid 727, which may be used to replace and/or replenish the cooling fluid 727 of the subsea heat removal systems 745. As another example, the storage tank 767 may contain a chemical additive that, when mixed with the cooling fluid 727, may enhance the performance (e.g., improve the thermal conductivity, reduce the viscosity, dissolve unwanted solids) of the cooling fluid 727.

Figure 8:
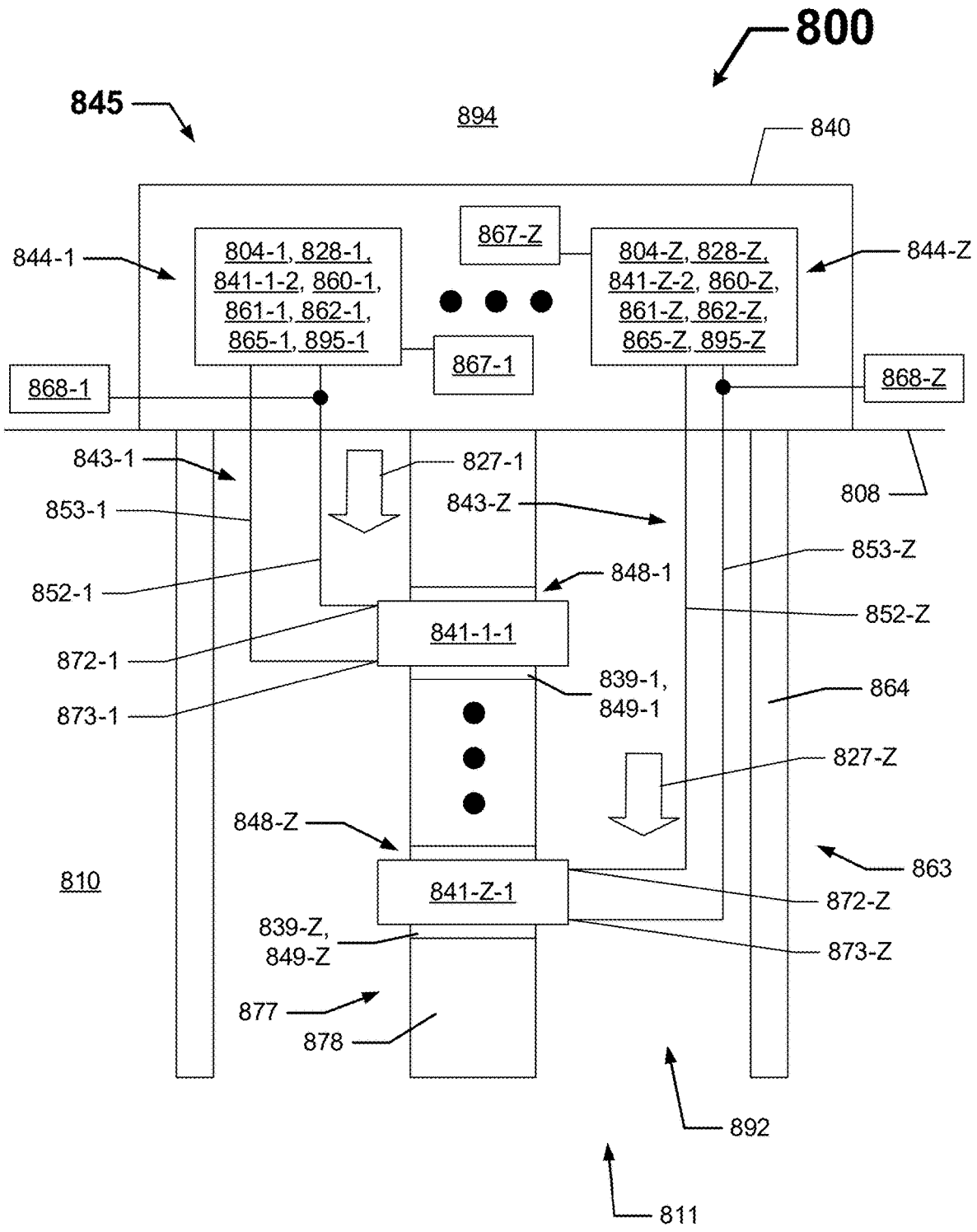
FIG. 8 shows a sectional view of another field system that includes multiple subsea heat removal systems according to certain example embodiments.

FIG. 8 shows a sectional view of another field system 800 that includes a subsea heat removal system 845 according to certain example embodiments. Referring to the description above with respect to FIGS. 1 through 7, the field system 800 of FIG. 8 shows a wellbore 811 drilled into a subterranean formation 810. A casing string 863 having a number of casing pipes 864 coupled to each other end to end is positioned within the wellbore 811 and set against the wall of the wellbore 811 with cement. The wall (e.g., wall 109) and the cement (e.g., cement 119) shown in the field system 100 of FIG. 1 are omitted in FIG. 8 to help simplify the drawing. The seabed 808 may be some distance (e.g., hundreds of feet, thousands of feet, miles) below the water line of the water 894.

A tubing string 877 is also positioned within the wellbore 811 inside of the casing string 863. The space between the tubing string 877 and the casing string 863 in the wellbore 811 is the annulus 892. The tubing string 877 in this example includes Z (e.g., 2, 3, 5, 10) subs 848 (sub 848-1 through sub 848-Z) and a number of tubing pipes 878 that are coupled to each other end-to-end to form the tubing string 877. In other words, the field system 800 may have a single sub 848 or multiple subs 848. Each sub 848 includes a body 849 (e.g., body 849-1 for sub 848-1, body 849-Z for sub 848-Z) and an electrical device 839 (e.g., electrical device 839-1 for sub 848-1, electrical device 839-Z for sub 848-Z). The body 849 of a sub 848 can have a wall that forms a cavity, inside of which is disposed the electrical device 839. The cavity of the body 849 of a sub 848 coincides with the cavity of the rest of the tubing string 877.

While not shown in FIG. 8 to simplify the drawing, the electrical device 839 of each sub 848 operates by receiving power and/or control signals from a power source (e.g., similar to power source 165) at or near the seabed 808 (e.g., integrated with the subsea Xmas tree 840) via power transfer links (e.g., similar to power transfer links 187) and/or communication links (e.g., similar to communication links 105), respectively. As discussed above, as each electrical device 839 operates, the electrical device 839 heats up. Also not shown in FIG. 8 in order to simply the drawing are any packers (e.g., similar to packer 166 of FIG. 1) that are used to isolate an environment (e.g., a pressure, a fluid) within the annulus 892 on each side of the packer and prevent fluidic communication therethrough.

The field system 800 of FIG. 8 also includes a subsea Xmas tree 840 (substantially similar to the subsea Xmas tree 140 of FIG. 1) that is mounted at the entry point (e.g., atop a wellhead) of the wellbore 811. The subsea Xmas tree 840 includes multiple (e.g., 2, 3, 5, 10) subsea heat removal systems 845. In this case, there are Z subsea heat removal systems 845 (subsea heat removal system 845-1 through subsea heat removal system 845-Z). Each subsea heat removal system 845 includes multiple seabed components 844. Specifically, the seabed components 844-1 of the subsea heat removal system 845-1 that are mounted on and/or integrated with the subsea Xmas tree 840 of FIG. 8 includes a controller 804-1, a cooling fluid source 828-1, a thermal transfer device 841-1-2, a sensor device 860-1, a pump 861-1, a motor 862-1, a power source 865-1, and a processing system 895-1.

Similarly, the seabed components 844-Z of the subsea heat removal system 845-Z that are mounted on and/or integrated with the subsea Xmas tree 840 of FIG. 8 includes a controller 804-Z, a cooling fluid source 828-Z, a thermal transfer device 841-Z-2, a sensor device 860-Z, a pump 861-Z, a motor 862-Z, a power source 865-Z, and a processing system 895-Z. The controllers 804, the cooling fluid sources 828, the thermal transfer devices 841, the sensor devices 860, the pumps 861, the motors 862, the power sources 865, and the processing systems 895 of FIG. 8 are substantially similar to the corresponding seabed components of the subsea heat removal systems discussed above with respect to FIGS. 1 through 3.

A power source 865 that is integrated with the subsea Xmas tree 840 or comes from other location (e.g., a generator on the topsides of a platform floating in the water 894, a transformer positioned at or near the seabed 808) is configured to provide power and/or control signals to the electrical devices 839 of the subs 848 (electrical device 839-1 of the sub 848-1 through the electrical device 839-Z of the sub 848-Z) via power transfer links (not shown in FIG. 8 to simplify the drawing, but substantially similar to the power transfer links 187 of FIG. 1 above) and/or communication links (not shown in FIG. 8 to simplify the drawing, but substantially similar to the communication links 105 of FIG. 1 above) in the form of one or more electrical cables that are positioned in the annulus 892.

Each subsea heat removal system 845 of FIG. 8 also includes multiple wellbore components 843. For example, the wellbore components 843-1 of the subsea heat removal system 845-1 include an inflow line 852-1, a thermal transfer device 841-1-1, and an outflow line 853-1 through which cooling fluid 827-1 flows. Similarly, the wellbore components 843-Z of the subsea heat removal system 845-Z include an inflow line 852-Z, a thermal transfer device 841-Z-1, and an outflow line 853-Z through which cooling fluid 827-Z flows. The inflow lines 852, the thermal transfer devices 841, and the outflow lines 853 are substantially similar to the corresponding wellbore components of the subsea heat removal systems discussed above with respect to FIGS. 1 through 3.

For the subsea heat removal system 845-1, the inflow line 852-1 is configured to allow the cooling fluid 827-1 to flow from a component (e.g., the pump 861-1) of the seabed components 844-1 of the subsea heat removal system 845-1 to the thermal transfer device 841-1-1. Part of the inflow line 852-1 (e.g., a proximal end or an inflow line proximal end) is positioned above the seabed 808 (e.g., in the water 894), and a remainder (e.g., a majority) of the inflow line 852-1 (e.g., a distal end or an inflow line distal end) is positioned in the annulus 892 in the wellbore 811.

The thermal transfer device 841-1-1 of the subsea heat removal system 845-1 is configured to absorb some of the heat generated by the electrical device 839-1 of the sub 848-1 and transfer this heat to the cooling fluid 827-1 that flows therethrough. The thermal transfer device 841-1-1 is made of or includes a thermally conductive material and is in thermal communication with the electrical device 839-1 of the sub 848-1 located in the wellbore 811. This allows heat from the electrical device 839-1 to be transferred to the thermal transfer device 841-1-1.

The thermal transfer device 841-1-1 includes an inlet 872-1 and an outlet 873-1. The inlet 872-1 is configured to connect to an end (e.g., a distal end) of the inflow line 852-1 (sometimes referred to as an inflow line distal end herein). When the inflow line 852-1 is connected to the inlet 872-1 of the thermal transfer device 841-1-1, the inlet 872-1 is configured to receive the cooling fluid 827-1 pumped down by the seabed components 844-1 of the subsea heat removal system 845-1. The cooling fluid 827-1 then flows through the thermal transfer device 841-1-1 and absorbs some of the heat that has been transferred to the thermal transfer device 841-1-1 by the electrical device 839-1.

The cooling fluid 827-1 that enters the inlet 872-1 of the thermal transfer device 841-1-1 exits the outlet 873-1 of the thermal transfer device 841-1-1 as a heated version of the cooling fluid 827-1. The outlet 873-1 is configured to connect to an end (e.g., a distal end) of the outflow line 853-1, which delivers the heated version of the cooling fluid 827-1 above the seabed 808. The subsea heat removal system 845-1 in this case is configured as a closed loop system. In this way, the heated version of the cooling fluid 827-1 flows through the thermal transfer device 841-1-2 located above the seabed 808 so that some of the heat of the cooling fluid 827-1 is transferred to the thermal transfer device 841-1-2, which allows the cooling fluid 827-1 to be recycled back into the wellbore 811 through the wellbore components 843 at a relatively lower temperature. In this case, the thermal transfer device 841-1-2 may be or include the outflow line 853-1 and/or piping (e.g., piping 288). At least some of the cooler temperature fluid used to remove heat from the cooling fluid 827-1 within the thermal transfer device 841-1-2 is the water 894 (e.g., having a temperature of 35° F. to 40° F.).

For the subsea heat removal system 845-Z, the inflow line 852-Z is configured to allow the cooling fluid 827-Z to flow from a component (e.g., the pump 661-Z) of the seabed components 844-Z of the subsea heat removal system 845-Z to the thermal transfer device 841-Z-1. Part of the inflow line 852-Z (e.g., a proximal end or an inflow line proximal end) is positioned above the seabed 808 (e.g., in the water 894), and a remainder (e.g., a majority) of the inflow line 852-Z (e.g., a distal end or an inflow line distal end) is positioned in the annulus 892 in the wellbore 811.

The thermal transfer device 841-Z-1 of the subsea heat removal system 845-Z is configured to absorb some of the heat generated by the electrical device 839-Z of the sub 848-Z and transfer this heat to the cooling fluid 827-Z that flows therethrough. The thermal transfer device 841-Z-1 is made of or includes a thermally conductive material and is in thermal communication with the electrical device 839-Z of the sub 848-Z located in the wellbore 811. This allows heat from the electrical device 839-Z to be transferred to the thermal transfer device 841-Z-1.

The thermal transfer device 841-Z-1 includes an inlet 872-Z and an outlet 873-Z. The inlet 872-Z is configured to connect to an end (e.g., a distal end) of the inflow line 852-Z (sometimes referred to as an inflow line distal end herein). When the inflow line 852-Z is connected to the inlet 872-Z of the thermal transfer device 841-Z-1, the inlet 872-Z is configured to receive the cooling fluid 827-Z pumped down by the seabed components 844-Z of the subsea heat removal system 845-Z. The cooling fluid 827-Z then flows through the thermal transfer device 841-Z-1 and absorbs some of the heat that has been transferred to the thermal transfer device 841-Z-1 by the electrical device 839-Z.

The cooling fluid 827-Z that enters the inlet 872-Z of the thermal transfer device 841-Z-1 exits the outlet 873-Z of the thermal transfer device 841-Z-1 as a heated version of the cooling fluid 827-Z. The outlet 873-Z is configured to connect to an end (e.g., a distal end) of the outflow line 853-Z, which delivers the heated version of the cooling fluid 827-Z above the seabed 808. The subsea heat removal system 845-Z in this case is configured as a closed loop system. In this way, the heated version of the cooling fluid 827-Z flows through the thermal transfer device 841-Z-2 located above the seabed 808 so that some of the heat of the cooling fluid 827-Z is transferred to the thermal transfer device 841-Z-2, which allows the cooling fluid 827-Z to be recycled back into the wellbore 811 through the wellbore components 843 at a relatively lower temperature. In this case, the thermal transfer device 841-Z-2 may be or include the outflow line 853-Z and/or piping (e.g., piping 288). At least some of the cooler temperature fluid used to remove heat from the cooling fluid 827-Z within the thermal transfer device 841-Z-2 is the water 894 (e.g., having a temperature of 35° F. to 40° F.).

When there are multiple example subsea heat removal systems 845 operating in a single wellbore 811, as in this case, the characteristics (e.g., chemical composition, viscosity, density) of one cooling fluid 827 may be substantially the same as, or different than, the corresponding characteristics of one or more of the other cooling fluids 827. In cases where the characteristics of two or more of the cooling fluids 827 are substantially the same, the associated subsea heat removal systems 845 may share one or more components (e.g., a pump 861, a motor 862, a cooling fluid source 828, some valves (e.g., similar to valves 285), some piping (e.g., similar to piping 288)).

In some cases, one or more of the subsea heat removal systems 845 may include one or more additional components and/or features. For example, as shown in FIG. 8, each subsea heat removal system 845 includes a port 868 (port 868-1 for subsea heat removal system 845-1, port 868-Z for subsea heat removal system 845-Z). Each port 868 is tied into the circulation system of the subsea heat removal system 845. In this case, port 868-1 is tied into the inflow line 852-1, and port 868-Z is tied into the outflow line 853-Z. Each port 868 may serve one or more of a number of functions. For example, a port 868 may allow a test probe (e.g., attached to a ROV or similar underwater vehicle) to extract a sample of the cooling fluid 827 for testing and analysis. As another example, a port 868 may allow for a replenishing volume of cooling fluid 827 to be injected into the circulation system of a subsea heat removal system 845.

An example of another additional component and/or feature of a subsea heat removal system 845 is a storage tank 867 (storage tank 867-1 for subsea heat removal system 845-1, storage tank 867-Z for subsea heat removal system 845-Z). Each storage tank 867 may be tied into the circulation system of one or more subsea heat removal systems 845. The release of the contents of a storage tank 867 may be regulated by one or more valves (e.g., similar to valves 285), which may be controlled by one or more controllers 804. Each storage tank 867 may have any of a number of different contents. For example, a storage tank 867 may contain additional cooling fluid 827, which may be used to replace and/or replenish the cooling fluid 827 of one or more subsea heat removal systems 845. As another example, a storage tank 867 may contain a chemical additive that, when mixed with the cooling fluid 827, may enhance the performance (e.g., improve the thermal conductivity, reduce the viscosity, dissolve unwanted solids) of the cooling fluid 827.

Figure 9:
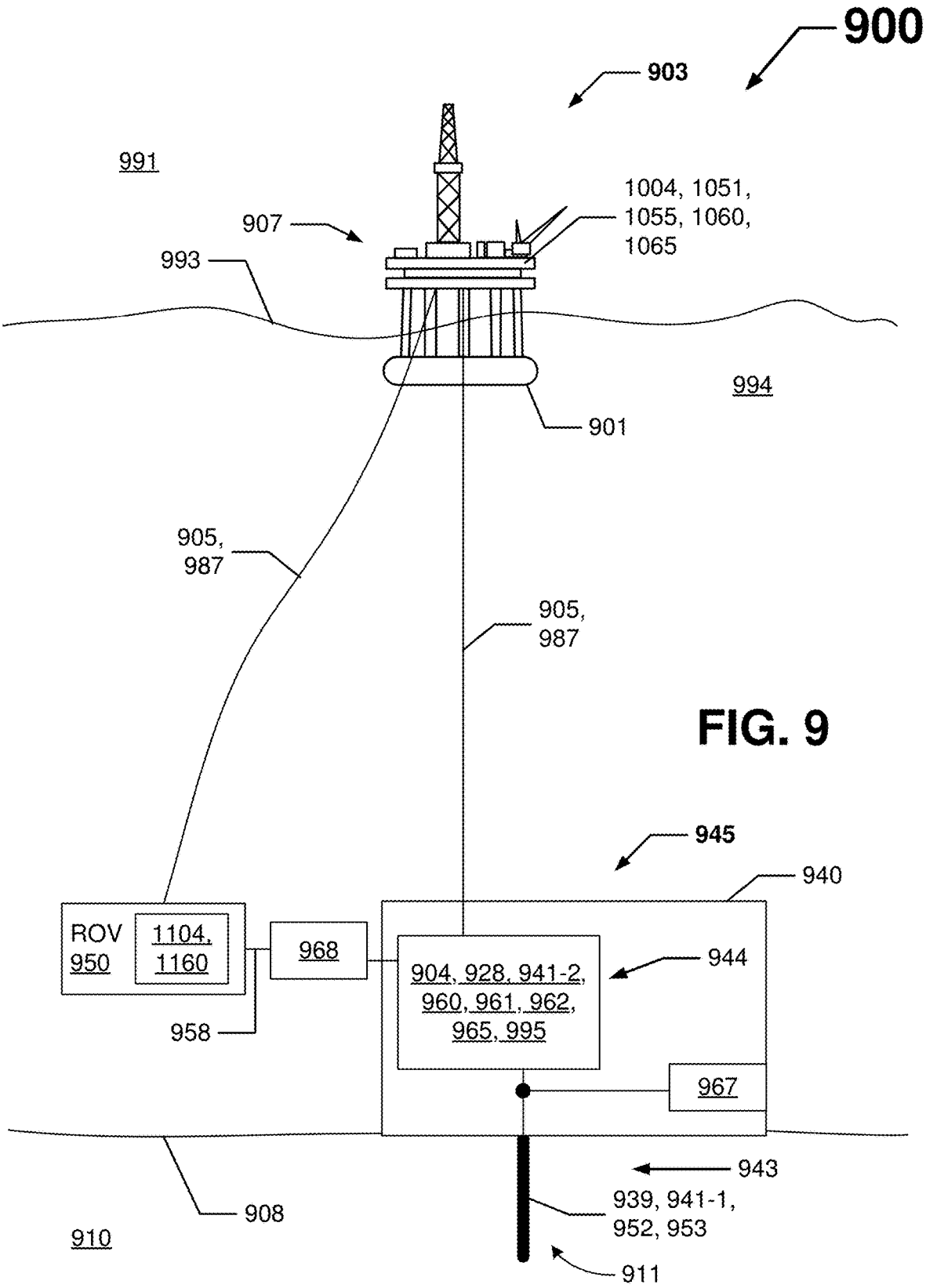
FIG. 9 shows another field system that includes a subsea heat removal system according to certain example embodiments.

FIG. 9 shows an embodiment of a field system 900 that includes a subsea heat removal system 945 according to certain example embodiments. Referring to the description above with respect to FIGS. 1 through 8, the field system 900 of FIG. 9 in this case includes a floating structure 903 in the form of a semi-submersible platform that floats in a large and deep body of water 994. Part (e.g., the topsides 907) of the floating structure 903 is exposed to air 991 above the water line 993, and at least part (e.g., part of the hull 901) of the rest of the floating structure 903 is in the water 994 (subsea) below the water line 993.

The floating structure 903 in this case is used for subterranean field operations (also called subsea field operations herein), in which exploration and production phases (also called stages) of the subsea field operation are executed to extract one or more subterranean resources (e.g., oil, natural gas, water, hydrogen gas) from and/or inject resources (e.g., carbon monoxide) into the subterranean formation 910 via a wellbore 911. Located on the topsides 907 of the floating structure 903 in this case are a power source 1065 (substantially similar to the power sources 265 discussed above), one or more controllers 1004 (substantially similar to the controllers 204 discussed above), one or more users 1051 (substantially similar to the users 251 discussed above), one or more user systems 1055 (substantially similar to the user systems 255 discussed above), and one or more sensor devices 1060 (substantially similar to the sensor devices 260 discussed above). There may be one or more of a number of other components (e.g., a compressor, communication equipment, pumps) of the field system 900 disposed on the topsides 907 of the floating structure 903.

In alternative embodiments, as when a subsea operation is in water 994 with relatively shallow depths, the structure 903 can be mounted on the seabed 908 with the topsides 907 raised above the water line 993. In addition, or in the alternative, the field system 900 may include multiple wellbores 911 that originate from the same proximate location (sometimes called a pad) on the seabed 908. In such cases, the wellbores 911 can be drilled one at a time, and the wellbores 911 from the pad can be on production simultaneously.

The subsea Xmas tree 940 is mounted atop the wellbore 911 at or near the seabed 908. The subsea Xmas tree 940 includes multiple seabed components 944 of the example subsea heat removal system 945, which is configured as a closed-loop system (as with the subsea heat removal system 745 of FIG. 7 and the subsea heat removal system 845 of FIG. 8). The seabed components 944 of the example subsea heat removal system 945 include a controller 904, a cooling fluid source 928, a thermal transfer device 941-2, one or more sensor devices 960, one or more motors 961, one or more pumps 962, one or more power sources 965, and a processing system 995. All of these seabed components 944 of the example subsea heat removal system 945 are substantially similar to the corresponding components of the seabed components of the example subsea heat removal system discussed above.

The seabed components 944 of the example subsea heat removal system 945 also includes a port 968 (substantially similar to the ports discussed above) and a storage tank 967 (substantially similar to the storage tanks discussed above) tied into the circulation system of the subsea heat removal system 945. Power and communication signals are delivered between the equipment on the floating structure 903 and the subsea Xmas tree 940 using power transfer links 987 (substantially similar to the power transfer links 287 discussed above) and communication links 905 (substantially similar to the communication links 205 discussed above) in the form of electrical cables in the water 994.

The subsea heat removal system 945 also includes multiple wellbore components 943. Specifically, the multiple wellbore components 943 of the subsea heat removal system 945 include an inflow line 952 (e.g., substantially similar to the inflow lines discussed above), a thermal transfer device 941-1 (e.g., substantially similar to the thermal transfer devices discussed above), and an outflow line 953 (e.g., substantially similar to the outflow lines discussed above) positioned within an annulus (e.g., substantially similar to the annuluses discussed above) of the wellbore 911. The thermal transfer device 941-1 is in thermal communication with the body (e.g., substantially similar to the bodies discussed above) of a sub (e.g., substantially similar to the subs discussed above) that includes the electrical device 939.

The field system 900 also includes a ROV 950 that moves within the water 994 to perform inspections, take measurements, and/or maintenance. The ROV 950 in this case is tethered to the topsides 907 of the floating structure 903 via a cable that may also serve as power transfer links 987 and/or communication links 905. In alternative embodiments, the ROV 950 may operate without a tether (e.g., include a battery or other form of energy storage device) and have wireless communication capabilities with the topsides 907 of the floating structure 903. The ROV 950 includes one or more controllers 1104 (e.g., substantially similar to the controllers 204 discussed above), one or more sensor devices 1160 (e.g., substantially similar to the sensor devices 260 discussed above), and an extension 958. The extension 958 may include a probe that may be inserted into the port 968 (e.g., to draw samples of the cooling fluid) and/or an arm that may interact with (e.g., change out, refill) the storage tank 967 and/or its contents.

In some cases, the controllers 1104 and the sensor devices 1160 may be used to manipulate and move the ROV 950. In other cases, the controllers 1104 and the sensor devices 1160 of the ROV 950 may additionally or alternatively be used to measure parameters associated with the subsea heat removal system 945. In yet other cases, the controllers 1104 and the sensor devices 1160 of the ROV 950 may additionally or alternatively be configured to communicate (e.g., using communication links 905 in wireless form) with one or more controllers 904 and/or one or more sensor devices 960 of the subsea heat removal system 945. In this way, a controller 1104 of the ROV 950 and/or a user system 1055 may be configured to assess the performance of the subsea heat removal system 945 or portions thereof.

Example embodiments can be used to reduce the temperature of one or more electrical devices in a tubing string within a wellbore by absorbing and removing heat generated by the electrical devices. Example embodiments may have a closed loop configuration or an open loop configuration. Example embodiments may include sensing capability to measure one or more parameters associated with the cooling fluid and/or performance of the subsea heat removal system. Example embodiments also provide a number of other benefits. Such other benefits can include, but are not limited to, improved useful life of the electrical devices, more reliable subterranean field operations, time savings, cost savings, and compliance with applicable industry standards and regulations.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A subsea heat removal system comprising:

a pump disposed in water near a seabed, wherein the pump is configured to pump a cooling fluid;

an inflow line having an inflow line distal end and an inflow line proximal end, wherein the inflow line proximal end is connected to the pump in the water and is configured to have the cooling fluid flow therethrough;

a thermal transfer device comprises an inlet and an outlet, wherein the inlet of the thermal transfer device is connected to the inflow line distal end, wherein the thermal transfer device comprises a thermally conductive material, and wherein the thermal transfer device is in thermal communication with an electrical device located in a wellbore; and an outflow line having an outflow line distal end and an outflow line proximal end, wherein the outflow line distal end is configured to be connected to the outlet of the thermal transfer device, wherein the outflow line is configured to have a heated version of the cooling fluid flow therethrough, and wherein the outflow line proximal end is located above the seabed.

2. The subsea heat removal system of claim 1, further comprising:

a second thermal transfer device made of a thermally conductive material, wherein the second thermal transfer device is configured to receive the heated version of the cooling fluid from the outflow line proximal end, and wherein the second thermal transfer device is further configured to deliver the cooling fluid to the inflow line proximal end.

3. The subsea heat removal system of claim 2, wherein the cooling fluid comprises a synthetic material.

4. The subsea heat removal system of claim 2, further comprising:

a port through which the cooling fluid is removed and through which a replacement cooling fluid is added.

5. The subsea heat removal system of claim 2, further comprising:

a storage tank for storing additional replacement fluid that is added to the cooling fluid when an amount of cooling fluid falls below a threshold value.

6. The subsea heat removal system of claim 1, wherein the outflow line proximal end and the inflow line proximal end are open to the water, and wherein the cooling fluid comprises the water.

7. The subsea heat removal system of claim 6, wherein the pump comprises a filter through which the water flows before entering the inflow line proximal end.

8. The subsea heat removal system of claim 1, wherein the inflow line and the outflow line are made of a flexible material.

9. The subsea heat removal system of claim 1, wherein the inflow line and the outflow line are made of a thermally non-conductive material.

10. The subsea heat removal system of claim 1, further comprising:

a motor to operate the pump.

11. The subsea heat removal system of claim 10, further comprising:

a battery that is configured to provide power to the motor.

12. The subsea heat removal system of claim 1, further comprising:

a sensor device that is configured to measure a parameter associated with pumping the cooling fluid through the thermal transfer device.

13. The subsea heat removal system of claim 12, further comprising:

a controller communicably coupled to the sensor device, wherein the controller is configured to evaluate a performance of the pump using measurements made by the sensor device.

14. A subsea field system comprising:

an electrical device located in a wellbore below a seabed; and a subsea heat removal system comprising:

a pump disposed in water near the seabed, wherein the pump is configured to pump a cooling fluid;

an inflow line having an inflow line distal end and an inflow line proximal end, wherein the inflow line proximal end is connected to the pump in the water and is configured to have the cooling fluid flow therethrough;

a thermal transfer device comprises an inlet and an outlet, wherein the inlet of the thermal transfer device is connected to the inflow line distal end, wherein the thermal transfer device comprises a thermally conductive material, and wherein the thermal transfer device is in thermal communication with the electrical device in the wellbore; and an outflow line having an outflow line distal end and an outflow line proximal end, wherein the outflow line distal end is configured to be connected to the outlet of the thermal transfer device, wherein the outflow line is configured to have a heated version of the cooling fluid flow therethrough, and wherein the outflow line proximal end terminates above the seabed.

15. The subsea field system of claim 14, further comprising:

an Xmas tree disposed at an entry point of the wellbore at the seabed, wherein the pump is mounted on the Xmas tree.

16. The subsea field system of claim 15, wherein the electrical device is provided electricity from a power source integrated with the Xmas tree.

17. The subsea field system of claim 16, wherein the power source is further configured to provide power to the pump.

18. The subsea field system of claim 14, wherein the electrical device comprises a valve.

19. The subsea field system of claim 14, wherein the electrical device is integrated with a tubing string in the wellbore.

20. The subsea field system of claim 14, wherein the inflow line and the outflow line are located between a tubing string and a casing string in the wellbore.

* * * * *